US012064074B2

(12) United States Patent
Park

(10) Patent No.: US 12,064,074 B2
(45) Date of Patent: Aug. 20, 2024

(54) DISHWASHER

(71) Applicant: LG Electronics Inc., Seoul (KR)

(72) Inventor: Dong Hwi Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/315,872

(22) Filed: May 10, 2021

(65) Prior Publication Data

US 2021/0353125 A1 Nov. 18, 2021

(30) Foreign Application Priority Data

May 12, 2020 (KR) ..... 10-2020-0056733

(51) Int. Cl.
*A47L 15/42* (2006.01)
*A47L 15/00* (2006.01)
*A47L 15/48* (2006.01)

(52) U.S. Cl.
CPC ..... *A47L 15/4287* (2013.01); *A47L 15/0034* (2013.01); *A47L 15/486* (2013.01); *A47L 15/488* (2013.01); *A47L 15/4257* (2013.01)

(58) Field of Classification Search
CPC ... A47L 15/0034; A47L 15/486; A47L 15/488
See application file for complete search history.

(56) References Cited

U.S. PATENT DOCUMENTS 5,881,746 A * 3/1999 Buser ..... A47L 15/488 134/58 DL
2003/0079760 A1* 5/2003 Spanyer ..... A47L 15/0034 134/25.2
2004/0163686 A1* 8/2004 Kang ..... A47L 15/486 134/186
2005/0126601 A1* 6/2005 Jung ..... A47L 15/4257 134/198
2006/0236556 A1 10/2006 Ferguson et al.
2007/0102026 A1* 5/2007 Ahn ..... A47L 15/0049 134/94.1
2008/0077281 A1* 3/2008 Gaus ..... A47L 15/485 700/299
2010/0043832 A1* 2/2010 Kim ..... A47L 15/4234 134/25.2
2010/0083991 A1* 4/2010 Tolf ..... A47L 15/488 134/95.2

(Continued)

FOREIGN PATENT DOCUMENTS

CN 110215176 A * 9/2019 ..... A47L 15/0013
CN 110464281 A * 11/2019

(Continued)

OTHER PUBLICATIONS

Extended European Search Report in European Appln. No. 21172457.0, dated Sep. 30, 2021, 10 pages.

*Primary Examiner* — Spencer E. Bell
*Assistant Examiner* — Omair Chaudhri
(74) *Attorney, Agent, or Firm* — Fish & Richardson P.C.

(57) ABSTRACT

A dishwasher is disclosed. When the dishwasher performs a drying process, the dishwasher increases a temperature of a washing space before air inside the washing space is discharged, thereby maintaining the temperature of the washing space at an appropriate drying temperature and increasing efficiency of the drying process.

6 Claims, 13 Drawing Sheets

(56) References Cited

U.S. PATENT DOCUMENTS

| | | | | |
|---|---|---|---|---|
| 2010/0139714 | A1* | 6/2010 | Alessandrelli | A47L 15/488 134/105 |
| 2010/0192977 | A1* | 8/2010 | Jadhav | A47L 15/4257 134/57 D |
| 2013/0055581 | A1* | 3/2013 | Eichholz | A47L 15/481 34/202 |
| 2013/0152974 | A1* | 6/2013 | Lee | A47L 15/0021 134/25.2 |
| 2013/0186437 | A1* | 7/2013 | Tuller | A47L 15/0084 134/99.1 |
| 2017/0150868 | A1* | 6/2017 | Ryu | A47L 15/486 |
| 2017/0196431 | A1* | 7/2017 | Hong | A47L 15/488 |
| 2017/0311771 | A1* | 11/2017 | Lutz | A47L 15/481 |
| 2017/0319045 | A1* | 11/2017 | Wu | A47L 15/488 |
| 2017/0325654 | A1* | 11/2017 | Doppelbauer | A47L 15/488 |
| 2018/0000311 | A1* | 1/2018 | Ryu | A47L 15/22 |
| 2018/0092508 | A1* | 4/2018 | Thiyagarajan | A47L 15/50 |
| 2020/0093346 | A1* | 3/2020 | Lutz | A47L 15/486 |
| 2020/0100644 | A1* | 4/2020 | Kopera | A47L 15/488 |
| 2021/0015338 | A1* | 1/2021 | Büsing | A47L 15/488 |
| 2021/0274993 | A1* | 9/2021 | Kopera | A47L 15/4259 |

FOREIGN PATENT DOCUMENTS

| | | | | |
|---|---|---|---|---|
| DE | 102013204003 | A1 * | 9/2014 | A47L 15/0034 |
| DE | 102019108965 | A1 * | 10/2020 | A47L 15/4291 |
| EP | 0687439 | | 12/1995 | |
| EP | 0711528 | | 5/1996 | |
| EP | 0953315 | A1 * | 11/1999 | |
| EP | 953315 | A1 * | 11/1999 | A47L 15/0034 |
| EP | 1733675 | | 12/2006 | |
| EP | 2371258 | A2 * | 10/2011 | A47L 15/0034 |
| EP | 2465406 | | 6/2012 | |
| EP | 2173229 | B1 * | 5/2014 | A47L 15/4287 |
| EP | 2790563 | B1 * | 7/2019 | A47L 15/0034 |
| JP | H0819502 | A * | 1/1996 | |
| KR | 101561772 | | 10/2015 | |
| WO | WO-2019041735 | A1 * | 3/2019 | A47L 15/0026 |
| WO | WO-2021238233 | A1 * | 12/2021 | |

* cited by examiner

DISHWASHER

CROSS-REFERENCE TO RELATED APPLICATION

This application claims priority to and the benefit of Korean Patent Application No. 10-2020-0056733, filed on May 12, 2020, the disclosure of which is incorporated herein by reference in its entirety.

1. BACKGROUND

Technical Field

The present disclosure relates to a dishwasher.

2. DESCRIPTION OF RELATED ART

A dishwasher may wash dirt such as food waste on washing objects such as the dishes or cooking utensils using detergent and washing water.

A washing course of the dishwasher may include a washing process of washing the washing object, a rinsing process of rinsing the washed object, and a drying process of drying the rinsed washing object. The processes are performed sequentially.

In the drying process, a process of evaporating the washing water (i.e., water) that is present at an outside of the washing object by increasing a temperature of a washing space may be performed. Based on that process, the washing object may be dried.

In this regard, a drying operation of a dishwasher in the prior art is described.

The prior art 1 is a dishwasher disclosed in KR 10-1561772 B1.

Referring to prior art 1, the dishwasher in the related art introduces external air, heats the introduced air, discharges the heated air into a washing space thereof, and evaporates washing water (i.e., water) on a washing object using the discharged heated air. For the heating, the dishwasher in the related art includes a heater to heat external air.

In this case, high-temperature humid air may be generated during the evaporation of the washing water and pressure inside the washing space increases due to the high-temperature humid air. The high-temperature humid air may be discharged and the dishwasher in the related art includes an additional exhaust duct, a blowing fan, and the like to discharge the air.

However, a structure of the dishwasher becomes complicated due to the exhaust duct and the blowing fan. In addition, as the air heating operation and the operation of the blowing fan are simultaneously performed, the control of the drying process is also complicated. In addition, when the exhaust duct and the blowing fan are used, all of the air is not discharged and water condenses on a surface of the washing object or on the wall of a tub due to the humid air as time passes.

The prior art 2 is a dishwasher disclosed in EP 1733675B1.

When the drying process is performed, the washing water on the washing object evaporates to generate humid air, and the generated humid air remains inside the washing space. The dishwasher of prior art 2 partially opens a door by a preset width using a locking plate and discharges the humid air by partially opening door. The door is partially opened during the drying process.

In addition, opening components for partially opening the door are also disclosed in EP 687439 A1 and EP 711528 A1, and humid air is discharged to the outside of the washing space using the components.

The rinsing process may perform an operation of rinsing the washing object using hot water and the temperature of the washing space increases due to spray of the hot water. In this case, the dishwasher in the related art performs a drying process by driving a heater after partially opening the door.

However, the temperature of the washing space is reduced by partially opening the door before the heater is driven. In this case, the washing object is not properly dried due to the reduced temperature of the washing space, thereby increasing an execution time period of the drying process.

That is, when the door is opened during the drying process, large heat loss may occur in the washing object and the washing space due to external air introduced into the dishwasher through the opened door. In addition, the temperature of the washing space may be maintained at a certain temperature or higher to perform the drying process. However, when the internal air of the washing space is excessively discharged through the door, the temperature of the washing space may become too low. In this case, the drying process thereof may not be efficiently performed. The heater and the fan may be operated at a high level to increase the temperature of the washing space, but in this case, a lot of power may be consumed and the execution time of the drying process may be lengthened.

That is, it is necessary to address the drying efficiency problem and the power problem by flexibly opening or closing the door in consideration of various parameters existing in the washing space, not by fixedly opening or closing the door according to a process sequence.

SUMMARY OF THE DISCLOSURE

The present disclosure provides a dishwasher to improve efficiency of a drying process.

The present disclosure also provides a dishwasher to prevent condensation of washing water in the drying process.

The present disclosure further provides a dishwasher having a simple structure and capable of discharging humid air presenting in a washing space using a simple control method.

The present disclosure further provides a dishwasher to prevent the washing object from being contaminated again by external contaminants after the drying process ends.

The present disclosure further provides a dishwasher to discharge high-temperature humid steam into a space between the door and the washing space by partially opening the door in the drying process and automatically close the door again after the drying process.

The present disclosure further provides a dishwasher to maintain the temperature of the washing space at an appropriate drying temperature during the drying process ends.

The present disclosure further provides a dishwasher to reduce a power required when increasing the temperature of the washing space to dry a washing object.

The present disclosure further provides a dishwasher capable of reducing an execution time of the drying process.

The objects of the present disclosure are not limited to the above-mentioned objects, and other objects and advantages of the present disclosure which are not mentioned may be understood by the following description and more clearly understood based on the embodiments of the present disclosure. In addition, the objects and the advantages of the present disclosure can be realized by features described in claims and a combination thereof.

To address the above-described problems, the dishwasher according to the present disclosure increases the temperature of the washing space before the air inside the washing space is discharged during the execution of the drying process.

Specifically, the air inside the washing space is discharged to the outside of the washing space at a first time point of the drying process of the washing object and a heater is turned on at a time point of the drying process before the first time point, thereby maintaining the temperature of the washing space at an appropriate drying temperature and improving the efficiency of the drying process.

In addition, the efficiency of the drying process may be improved similar to the above case by discharging the air inside the washing space and turning on the heater simultaneously at the first time point of the drying process of the washing object.

In addition, according to the present disclosure, the dishwasher may prevent condensation of washing water on a washing object or the wall of the washing space by discharging air inside the washing space during the execution of the drying process.

In addition, according to the present disclosure, the dishwasher may prevent recontamination of the washing object by automatically closing the door when the drying process ends.

According to an embodiment of the present disclosure, a dishwasher includes a tub defining a washing space, a door disposed on a front surface of the tub and configured to open or close the washing space, a rack disposed in the tub and configured to accommodate a washing object, and a heater configured to increase a temperature inside the washing space, the air inside the washing space is discharged to an outside of the tub at a first time point in the drying process of the washing object and the heater is turned on at a time point of the drying process before the first time point.

The dishwasher further includes a first fan configured to suction external air to dry the washing object, the heater heats the suctioned air and the heated air is discharged into the washing space to increase the temperature inside the washing space.

The door may be closed at a time point before the first time point, the door may be partially opened at the first time point, air in the washing space may be discharged to the outside of the tub through the partially open door, and the door may be closed at an end time point of the drying process.

The dishwasher may further include a door driver to partially open the closed door or close the partially opened door.

The partially opened door may be closed at a second time point after the first time point, the closed door may be opened again at a third time point after the second time point, and the second time point and the third time point may be included in the drying process.

The first fan and the heater may be turned on simultaneously at a fourth time point before the first time point and the fourth time point may be included in the drying process.

The heater is turned on at the fourth time point before the first time point, the first fan is turned on at a fifth time point between the fourth time point and the first time point, and the fourth time point and the fifth time point may be included in the drying process.

The heater is turned on at the fourth time point before the first time point, the first fan is turned on at the first time point, and the fourth time point may be included in the drying process.

The dishwasher further includes an exhaust outlet configured to discharge air inside the washing space to an outside of the tub and a cover configured to open or close the exhaust outlet, when the cover is closed, the air inside the washing space is not discharged to the outside of the tub, when the cover is opened, the air inside the washing space is discharged to the outside of the tub, and the cover is opened at the first time point to discharge the air inside the washing space to the outside of the tub through the exhaust outlet.

The dishwasher further includes a second fan disposed inside the exhaust outlet and configured to discharge the air inside the washing space to an outside of the tub, the second fan may be turned on when the cover is opened and may be turned off when the cover is closed.

The exhaust outlet and the cover may each be disposed inside the door or at a portion of the tub.

The open cover is closed at the second time point after the first time point, the closed cover is opened again at the third time point after the second time point, and the second time point and the third time point may be included in the drying process.

A rinsing process of the washing object using hot water is performed before the drying process of the washing object and a heating level of the heater that is turned on at a time point before the first time point may be set based on the temperature of the washing space measured at an end time point of the rinsing process.

The heating level of the heater or the discharge of the air inside the washing space at the time point after the first time point may be adjusted based on the temperature of the washing space measured at the time point after the first time point.

The heating level of the heater at the time point before the first time point is a first heating level, and when a temperature of the washing space measured at a sixth time point after the first time point is reduced to a first threshold temperature or less, the heating level of the heater at the sixth time point may be adjusted to a second heating level that is greater than the first heating level, and the sixth time point may be included in the drying process.

When the temperature of the washing space reaches a second threshold temperature that is greater than the first threshold temperature at a seventh time point after the sixth time point, the heating level of the heater returns to the first heating level and the seventh time point may be included in the drying process.

The air inside the washing space is not discharged at the time point before the first time point, the air inside the washing space is discharged at the first time point, and if the temperature of the washing space measured at the sixth time point after the first time pint is reduced to a first threshold temperature or less, the air inside the washing space is not discharged, and the sixth time point may be included in the drying process.

When the temperature of the washing space reaches a second threshold temperature that is greater than the first threshold temperature at a seventh time point after the sixth time point, the air inside the washing space is discharged again, and the seventh time point may be included in the drying process.

In addition, according to another embodiment of the present disclosure, the dishwasher includes a tub defining a washing space, a door disposed on a front surface of the tub and configured to open or close the washing space, a rack disposed in the tub and configured to accommodate the washing object, a first fan configured to suction air to dry the washing space, a heater configured to heat the suctioned air, and a controller configured to control the fan, the heater, and the door, and the controller is configured to control the door to be partially opened, the first fan to be turned on, and the heater to be turned on simultaneously at the first time point of the drying process of the washing object.

In addition, according to another embodiment of the present disclosure, a method for controlling the dishwasher includes turning on, by the controller, the heater at time point A of the drying process, partially opening, by the controller, the door at time point B included in the drying process and which is a time point after the time point A, and discharging air.

According to the present disclosure, the temperature of the washing space may be maintained at an appropriate drying temperature during the drying process of the dishwasher.

According to the present disclosure, the efficiency of the drying process may be improved based on the appropriately-maintained drying temperature of the washing space.

Further, according to the present disclosure, the dishwasher may reduce the power used to increase the temperature of the washing space.

Further, according to the present disclosure, the dishwasher may reduce the execution time period of the drying process.

Hereafter, further effects of the present disclosure, in addition to the above-mentioned effect, are described together while describing specific matters for implementing the present disclosure.

DETAILED DESCRIPTION OF EXEMPLARY IMPLEMENTATIONS

Figure 1:
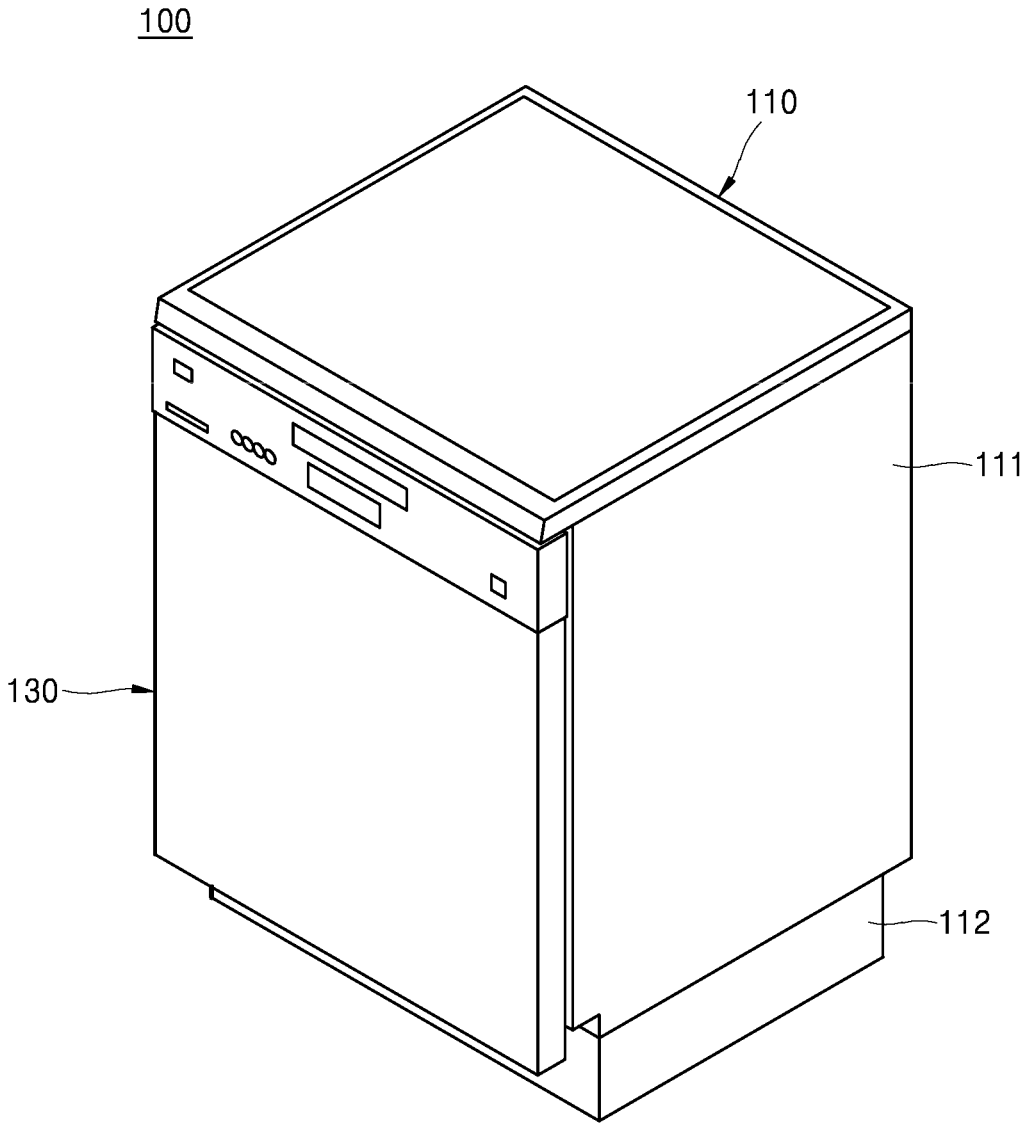
FIG. 1 is a perspective view showing an example dishwasher when viewed from an upper right side.

Some embodiments of the present disclosure are described in detail with reference to accompanying drawings. Therefore, a person having ordinary knowledge in the art to which the present disclosure pertains may easily implement the technical idea of the present disclosure. In the description of the present disclosure, a detailed description of the known technology relating to the present disclosure may be omitted if it unnecessarily obscures the gist of the present disclosure. Hereinafter, one or more embodiments of the present disclosure are described in detail with reference to the accompanying drawings. Same reference numerals may be used to refer to same or similar component in the figures.

It is understood that, the terms "first", "second", and the like may be used herein to describe various components, however, these components should not be limited by these terms. These terms are only used to distinguish one component from another component. Thus, a first component may be a second component unless otherwise stated Hereinafter, when any component is arranged at "an upper portion (or a lower portion)" of the component or "on (or under") of the component, any component may be arranged in contact with an upper surface (or a lower surface) of the component, and another component may be disposed between the component and any component arranged on (or under) the component.

Further, the terms "connected," "coupled," or the like are used such that, where a first component is connected or coupled to a second component, the first component may be directly connected or able to be connected to the second component, or one or more additional components may be disposed between the first and second components, or the first and second components may be connected or coupled through one or more additional components.

Unless otherwise stated, each component may be singular or plural throughout the disclosure.

As used herein, the singular forms "a," "an" and "the" are intended to include the plural forms as well, unless the context clearly indicates otherwise. In the present disclosure, it should not be construed that terms such as "including" or "comprising" necessarily include various types of components or various steps described in the present disclosure, and it should be construed terms such as "including" or "comprising" do not include some components or some steps or may include additional components or steps.

In the present disclosure, unless otherwise stated, "A and/or B" means A, B, or both. Unless otherwise stated, "C to D" means "C or more and D or less".

Hereinafter, a dishwasher according to some embodiments of the present disclosure is described.

[Structure of Dishwasher]

Figure 2:
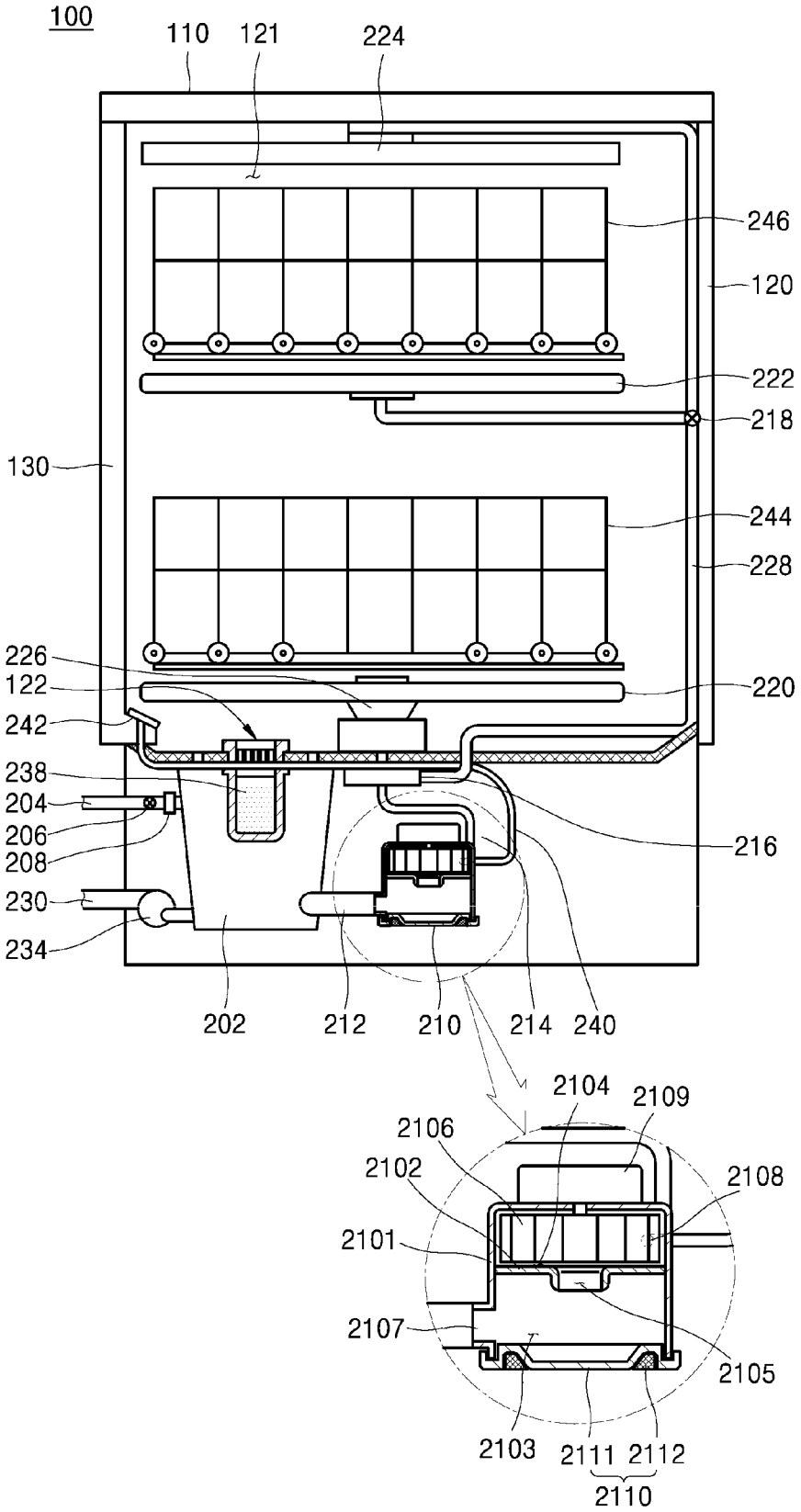
FIG. 2 is a cross-sectional view of an example dishwasher.

FIG. 1 is a perspective view showing an example dishwasher when viewed from an upper right side. FIG. 2 is a cross-sectional view of an example dishwasher.

A structure of a dishwasher 100 is described in detail with reference to FIGS. 1 and 2.

A case 110 defines an outer appearance of the dishwasher 100 and includes an upper space 111 and a lower space 112.

A tub 120 is disposed in the upper space 111 of the case 110. The tub 120 may have a hexahedral shape with an open front surface. However, the shape of the tub 120 is not limited thereto, and the tub 120 may have various shapes.

The tub 120 includes a washing space 121 configured to accommodate washing objects (e.g., the dishes, cooking utensils, and the like). In addition, the tub 120 includes a connection hole 122 at a bottom thereof to introduce washing water into a sump 202.

A door 130 is disposed on a front surface of the tub 120 and opens or closes the washing space 121.

FIGS. 1 to 2 show a dishwasher 100 including a first-stage door 130. However, the present disclosure is not limited thereto. That is, the dishwasher 100 including a multi-stage door 130 may be used in the present disclosure.

The door 130 has at least one of an open state, a partially open state, or a closed state.

The open state is an arrangement state of the door 130 when an entrance of a washing space 121 is completely opened. When the door 130 is in the open state, the user may accommodate the washing object in the completely opened washing space 121.

The closed state is an arrangement state of the door 130 when the entrance of the washing space 121 is completely closed. When the door 130 is in the closed state, operations such as a washing process and a rinsing process may be performed on the washing object.

The partially open state is an arrangement state of the door 130 when the entrance of the washing space 121 is partially opened. When the door 130 is partially open, humid air in the washing space 121 may be discharged to an outside of the washing space 121, that is, to an outer space of the tub 120.

The partially open state is a fixed state. That is, if an external force is not applied, the door 130 maintains the partially open state.

Meanwhile, although not shown in FIGS. 1 and 2, a door driver may be disposed on at least a portion of the door 130 and the case 110 to open or close the door 130, in particular, partially open the door 130.

The door driver may include a motor and the like and partially opens the closed door 130 or closes the partially open door 130. That is, a first operation of partially opening the closed door 130 and a second operation of closing the partially opened door 130 may be performed by the door driver, not by an external force of the user. The door driver to perform the first operation and the second operation may be used for the present disclosure.

Figure 3:
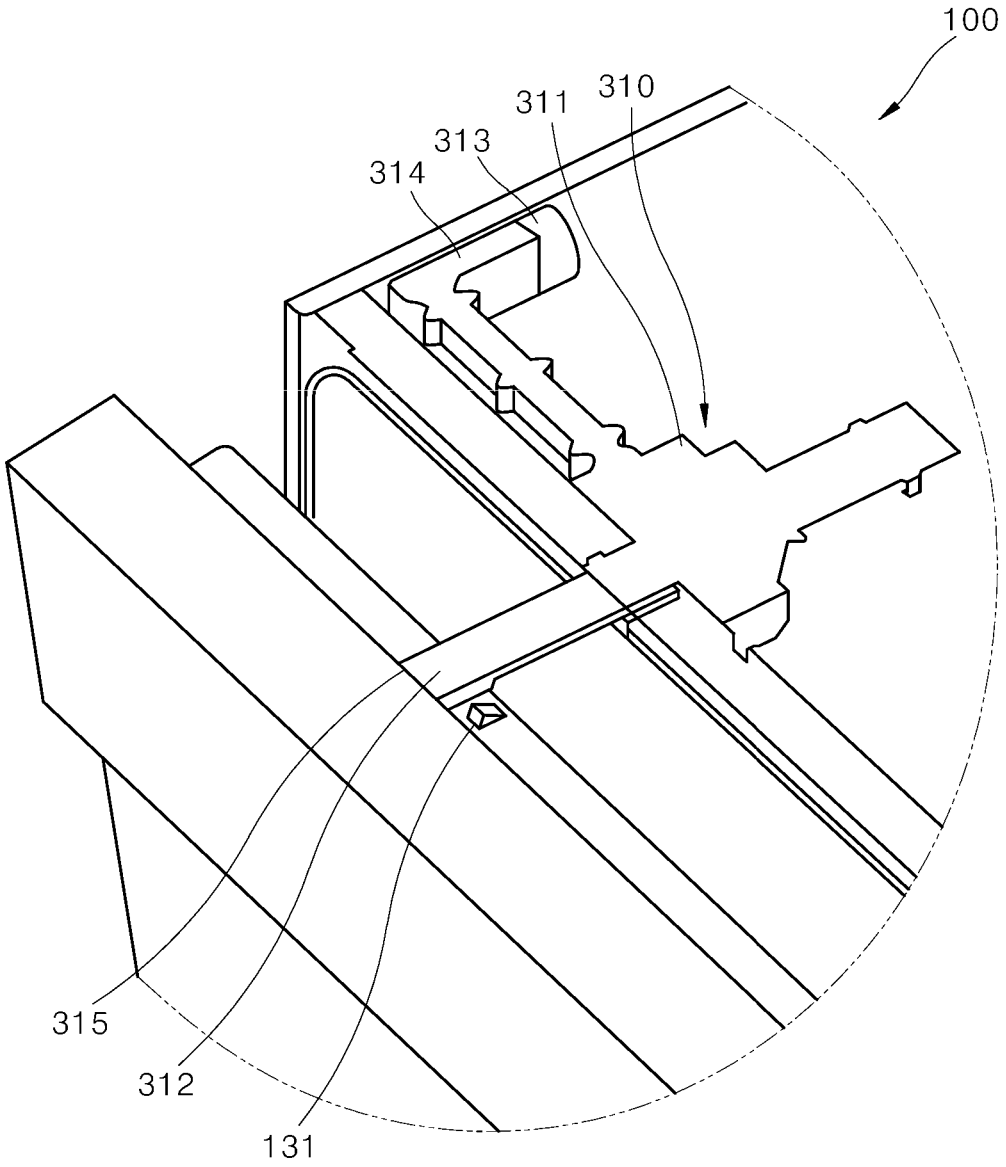
FIG. 3 shows an example shape of a door driver of a dishwasher.

FIG. 3 shows an example of a door driver 310.

Referring to FIG. 3, the door driver 310 is disposed at an upper portion of a tub 120.

The door driver 310 includes a housing 311, an opening bar 312, a motor 313, and a transmission stage 314.

The housing 311 defines an outer appearance of the door driver 310.

The open bar 312 may be a push-type open bar and is moved by the motor 313. A driving force of the motor 313 is transmitted through the transmission stage 314.

A rotational axis of a shaft of the motor 313 extends in parallel to a moving direction of the open bar 312. That is, the open bar 312 moves forward and rearward along an opening or closing direction of the door 130.

A protrusion 315 is defined at an end of the open bar 312 and a locking portion 131 is defined on an upper surface of the door 130. The locking portion 131 is engaged with the protrusion 315 defined at the end of the open bar 312.

The arrangement state of the door 130 according to an open length of the open bar 312 is described as follows.

When the opening bar 312 is adjacent to the end of the housing 311 and is not opened, the door 130 is closed. In this case, the protrusion 315 and the locking portion 131 are engaged with each other.

When the opening bar 312 is opened by a first opening length, the protrusion 315 and the locking portion 131 remain engaged. In this case, the door 130 is partially opened.

When the opening bar 312 is opened by the first opening length or more, the engaged state of the protrusion 315 and the locking portion 131 is released by gravity. In this case, the door 130 is completely open.

The structure of the dishwasher 100 is described with reference to FIGS. 1 and 2 again.

A sump 202 is disposed under a bottom of the tub 120, that is, in a lower space 112 of the case 110. The sump 202 stores the washing water and collects the washing water that has washed the washing object.

The sump 202 is connected to a water supply flow path 204 through which washing water supplied from an external water source flows. In addition, the water supply valve 206 flows the washing water supplied from the external water source through the water supply flow path 204 to the sump 202. When the water supply valve 206 is opened, the washing water supplied from the external water source is introduced into the sump 202 through the water supply flow path 204.

The water supply flow path 204 includes a flow meter 208. The flow meter 208 measures a flow rate of the washing water flowing to the sump 202.

A plurality of racks 244 and 246 are disposed in the washing space 121 to store washing objects such as the dishes and bottles.

The plurality of racks 244 and 246 may include a lower rack 244 disposed at a lower portion of the washing space 121 and an upper rack 246 disposed at an upper portion of the washing space 121. The lower rack 244 and the upper rack 246 may be spaced apart from each other in a vertical direction, may slid forward the tub 120, and may be taken out. The user may store the washing object in the taken-out lower rack 224 and upper rack 246.

The washing pump 210 is connected to the sump 202 through a water collecting flow path 212. The washing pump 210 supplies the washing water stored in the sump 202 to a plurality of spray arms 220, 222, and 224 through the spray arm connection flow paths 226 and 228.

The washing pump 210 may include a pump body 2101 coupled inside the case 110, a partition wall 2102 configured to divide an inner space of the pump body 2101 into a first pump space 2103 and a second pump space 2104 in the pump body 2101, a partition wall through-hole 2105 defined in the partition wall 2101 and to communicate the first pump space 2103 with the second pump space 2104, and an impeller 2106 disposed in the second pump space 2104.

The first pump space 2013 is connected to the sump 202 through a pump inlet 2107 to pass through the pump body 2101 and the second pump space 2104 is connected to a washing water supply flow path 214 and a steam hose 240 through a pump discharger 2108 to pass through the pump body 2101.

An impeller 2106 is rotated by a washing motor 2109 coupled to the pump body 2101 and a rotary shaft of the washing motor 2109 is connected to the impeller 2106 through an upper surface of the pump body 2101.

Meanwhile, a heater 2110 is disposed on a bottom surface of the first pump space 2013. When the pump body 2101 has a cylindrical shape with an open lower surface, the heater 2110 may form the bottom surface of the first pump space 2103.

The heater 2110 may include a heating plate 2111 configured to define a bottom surface of the first pump space 2103 and a first heater 2112 coupled to the heating plate 211 and disposed at an outside of the first pump space 2103. The heating plate 2111 may be made of metal to facilitate heat transfer.

In short, the first heater 2112 is coupled to a lower side of the washing pump 210 to heat the washing water in the washing pump 210. When the washing pump 210 is driven, the first heater 2112 heats the washing water flowing inside the washing pump 210 to generate hot water. The first heater 2112 generates steam by heating the washing water present in the washing pump 210 while maintaining a level of the washing water present in the washing pump 210 at a predetermined level or higher. For example, the first heater 2112 may generate steam by heating the washing water present in the washing pump 210 when the washing pump 210 is driven, or may generate steam by heating the washing water stored in the washing pump 210 when the washing pump 210 stops driving. The hot water generated by the first heater 2112 is sprayed into the tub 120 through at least one of a plurality of spray arms 220, 222, and 224. In addition, the steam generated by the first heater 2112 flows along the steam hose 240 and is discharged into the washing space 121 through a steam nozzle 242.

A check valve is disposed within the water collecting flow path 212, that is, between the sump 202 and the washing pump 210. The check valve opens toward the washing pump 210 from the sump 202. That is, the check valve is opened to flow the washing water from the sump 202 to the washing pump 210 and is closed to block flow of the washing water from the washing pump 210 to the sump 202. In other words, when the washing pump 210 is driven and the washing water flows, the check valve is opened, and when the washing pump 210 stops driving and the washing water does not flow, the check valve is closed. The check valve is opened by rotating a lower portion thereof about an upper portion thereof based on flow pressure of the washing water in the washing pump 210. For example, the check valve may be a solenoid valve that is opened or closed based on an electronic signal.

When the washing pump 210 is driven, the washing water stored in the sump 202 flows into the washing pump 210 through the water collecting flow path 212 and the introduced washing water is transmitted to a first changing valve 216 through the washing water supply flow path 214.

In addition to the first changing valve 216, a second changing valve 218 selectively supplies the washing water transferred by the washing pump 210 to the at least one of the plurality of spray arms 220, 222, and 224. That is, the changing valves 216 and 218 selectively connect the washing pump 210 to the at least one of the plurality of spray arms 220, 222, and 224.

The plurality of spray arms 220, 222, and 224 spray the washing water into the washing space 121. The plurality of spray arms 220, 222, and 224 include a lower spray arm 220, an upper spray arm 222, and a top spray arm 224 that are spaced apart from one another in a vertical direction.

The changing valves 216 and 218 are connected to the spray arm connecting flow paths 226 and 228 to supply the washing water to the plurality of spray arms 220, 222 and 224. The spray arm connecting flow paths 226 and 228 include a lower spray arm connection flow path 226 to supply washing water to the lower spray arm 220 and an upper spray arm connection flow path 228 to supply washing water to the upper spray arm 222 and the top spray arm 224.

The lower spray arm 220 is disposed at a lowermost side of the washing space 121 and sprays the washing water from the lower side to the upper side toward the lower rack 244. The upper spray arm 222 is disposed above the lower spray arm 220 at a middle portion of the washing space 121 and sprays the washing water from the lower side to the upper side toward the upper rack 246. The top spray arm 224 is disposed at an uppermost side of the washing space 121 and sprays the washing water from the top to the bottom.

A drain flow path 230 is connected to the sump 202. The drain flow path 230 transfers the washing water stored in the sump 202 to the outside of the dishwasher 100.

A drain pump 234 drains the washing water in the sump 202 through the drain flow path 230. The drain pump 234 includes a drain motor to generate a rotational force. When the drain pump 234 operates, the washing water stored in the sump 202 is discharged to the outside of the case 110 through the drain flow path 230.

A filter 238 is inserted into the connection hole 122 to filter dirt from the washing water flowing from the washing space 121 to the sump 202.

Meanwhile, the dishwasher 100 may further include a controller.

The controller controls driving of components of the dishwasher 100 and controls the operation of the dishwasher 100. The controller may be a processor-based device. The processor may include at least one of a central processing unit, an application processor, or a communication processor.

The controller controls the water supply valve 206, the washing pump 210, the drain pump 234, and the changing valves 216 and 218 to wash the washing object. In this case, the controller may control the driving of the components of the dishwasher 100 to perform the washing process, the rinsing process, and the drying process.

The washing process includes a preliminary washing process and a main washing process.

The preliminary washing process is a process of preliminarily removing the dirt adhered to the washing object by spraying the washing water to the washing object.

The controller controls the water supply valve 206 to supply the washing water to the sump 202 from the external water source. In addition, the controller controls the washing pump 210 to transfer the washing water stored in the sump 202 and controls the changing valves 216 and 218 to spray the washing water through the at least one of the plurality of spray arms 220, 222, and 224. The sprayed washing water drops the dirt adhered to the washing object to the bottom of the tub 220 and the dirt is collected in the filter 238. The controller controls the drain pump 234 to drain the washing water stored in the sump 202 to the outside.

The main washing process is a main process of the dishwasher 100 of spraying the heated washing water to the washing object to remove the dirt adhered to the washing object.

The controller controls the water supply valve 206 to supply the washing water to the sump 202 from the external water source. In addition, the controller controls the first heater 2112 to heat the washing water and controls the washing pump 210 to spray the heated washing water through the at least one of the plurality of spray arms 220, 222, and 224. In addition, the controller controls the drain pump 234 to drain the washing water stored in the sump 202 to the outside.

The rinsing process is a process of removing residual dirt adhered to the washing object.

The controller controls the water supply valve 206 to supply the washing water to the sump 202 from the external water source. In addition, the controller controls the washing pump 210 to spray the washing water from the at least one of the plurality of spray arms 220, 222, and 224. The controller controls the drain pump 234 to drain the washing water stored in the sump 202 to the outside.

In this case, the rinsing process may be a heating rinsing process. The controller controls the first heater 2112 to heat the washing water and controls the washing pump 210 to spray the heated washing water from the at least one of the plurality of spray arms 220, 222, and 224

The drying process is a process of drying the washing object with the washing water. The controller increases the temperature of the washing space 121 to dry the washing object. For the drying, a drying device is disposed in the dishwasher 100.

[Drying Device]

Figure 4:
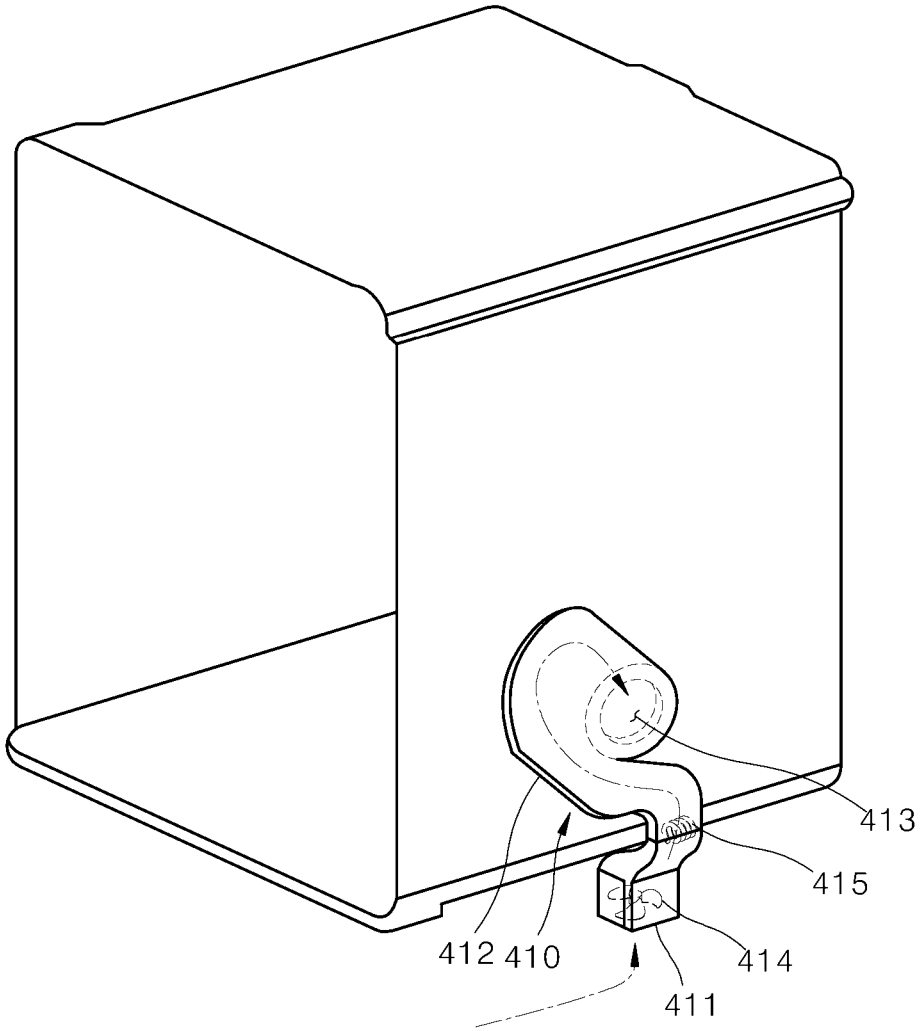
FIG. 4 is a perspective view showing an example drying device.

FIG. 4 is a perspective view showing an example drying device.

Referring to FIG. 4, the drying device may be a hot air device 410.

The hot air device 410 includes an air inlet 411, a flow path duct 412, an air discharge outlet 413, a first fan 414, and a second heater 415.

The air inlet 411 is defined at a side of a case 110 and communicates an outer space of the dishwasher 100 with flow path duct 412. Air outside the dishwasher 100 is introduced through the air inlet 411.

The flow path duct 412 guides the hot air to the washing space 121. A first end of the flow path duct 412 is connected to the air inlet 411 and a second end of the flow path duct 412 is connected to the air discharge outlet 413. The first fan 414 and the second heater 415 are each disposed inside the flow path duct 412.

The air discharge outlet 413 is a discharge outlet through which the heated air flowing through the flow path duct 412 is discharged to the washing space 121. The air discharge outlet 413 may be defined at a side of the tub 120.

The first fan 414 is disposed at the first end of the flow path duct 412 adjacent to the air inlet 411 and introduces air outside the dishwasher 100 into the flow path duct 412. That is, the air outside the dishwasher 100 is more introduced into the flow path duct 412 using the first fan 414.

The operation of the first fan 414 may be controlled by the controller. For example, when the process of the dishwasher 100 is a washing process or a rinsing process, the controller may turn off the first fan 414. As another example, when the process of the dishwasher 100 is a drying process, the controller may turn on the first fan 414.

The second heater 415 is disposed adjacent to the first fan 414 and heats the outside air.

For example, a distance between the air inlet 411 and the second heater 415 may be larger than a distance between the air inlet 411 and the first fan 414. That is, the second heater 415 may be disposed inside the flow path duct 412 than the first fan 414. However, the present disclosure is not limited thereto, and the distance between the air inlet 411 and the first fan 414 may be larger than the distance between the air inlet 411 and the second heater 415.

Air outside of the dishwasher 100 is introduced into the flow path duct 412 through the first fan 414, the introduced air is heated by the second heater 415 and is discharged to the washing space 121, and the temperature inside the washing space 121 is increased based on the heated temperature. In this case, the washing water present on the washing object is evaporated to dry the washing object.

Figure 5:
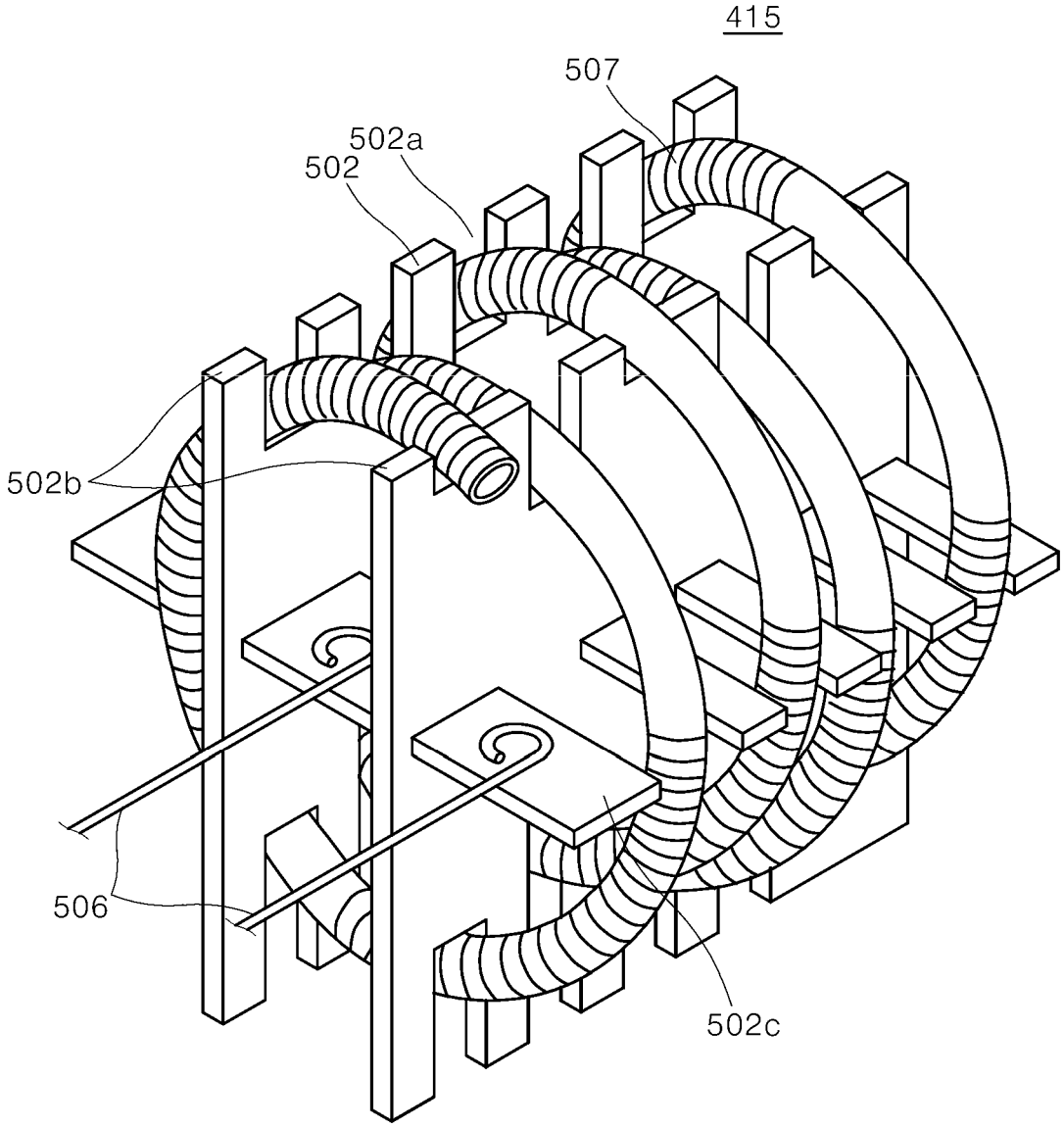
FIG. 5 is a perspective view showing an example second heater.
Figure 6:
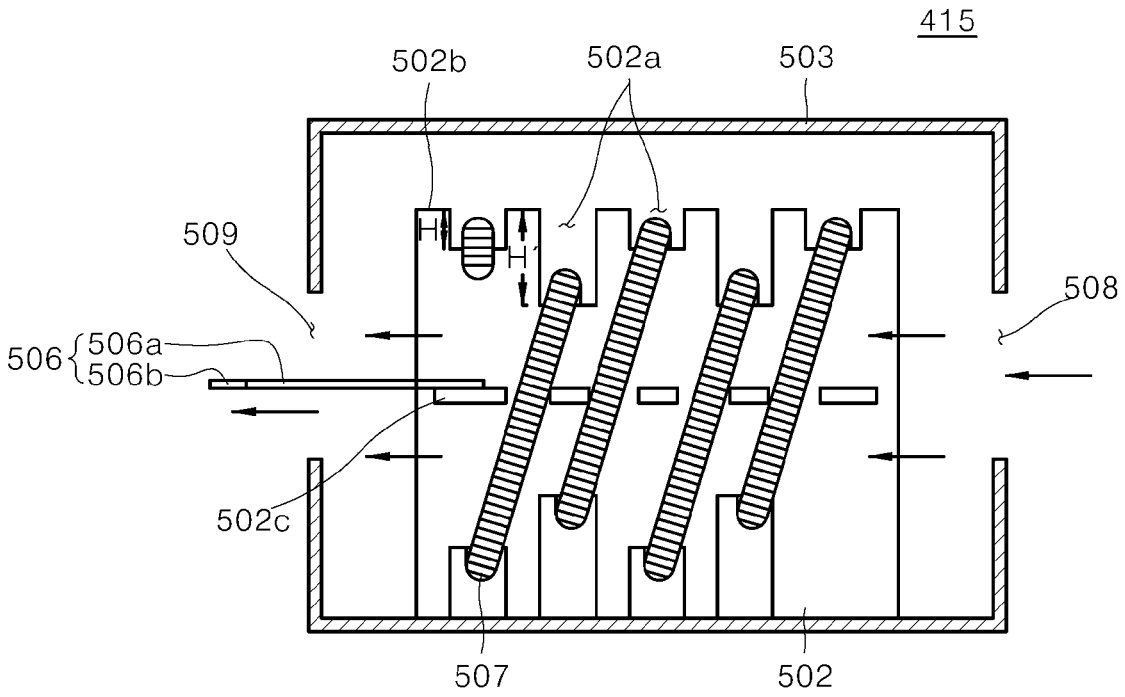
FIG. 6 is a cross-sectional view of an example second heater.

FIG. 5 is a perspective view showing an example second heater 415. FIG. 6 is a cross-sectional view of an example second heater 415.

Referring to FIGS. 5 to 6, the second heater 415 includes heater cases 502 and 503, a heating wire 507, and a fuse 506.

The heater cases 502 and 503 accommodate the heating wire 507 and define an outer appearance of the second heater 415.

The heating wire 507 heats the outside air to dry the washing object.

When the heating wire 507 is overheated, the fuse 506 short-circuits a power supplied to the heating wire 507.

The fuse 506 includes a pair of leads 506*a* arranged in parallel to each other and connected to the heating wire 507 and a temperature sensing fuse 506*b* connected between the pair of leads 506*a* and to measure a temperature of air.

When the surrounding air is overheated to a set temperature or higher, the temperature sensing fuse 506*b* detects the overheating thereof and short-circuits to cut off a power of the heating wire 507. The fuse 506 including the temperature sensing fuse 506*b* may be disposed adjacent to the air discharge outlet 413 through which air heated by the heating wire 507 is discharged. That is, when the fuse 506 is provided at a position adjacent to an air discharge outlet 413, as the air around the air discharge outlet 413 is heated by the heating wire 507, the temperature sensing fuse 506*b* may detect the temperature of the heated air.

The heater cases 502 and 503 include a cover 503 defining an outer appearance and a heating wire accommodating housing 502 disposed inside the cover 503 to accommodate the heating wire 507.

An air inlet 508 is defined at a first side of the cover 503 to introduce external air of the cover 503 and an air discharge outlet 509 is defined at a second side of the cover 503 to discharge the inner air of the cover 503 to outside.

The heating wire 507 is connected to an external power source, generates heat to heat the surrounding air, and may be wound around the heating wire accommodating housing 502 with different height differences.

Specifically, the heating wire receiving housing 502 includes vertical insulators 502*b* arranged perpendicularly at an interior of the dishwasher 100 and spaced apart from one another by a predetermined distance. In addition, the heating wire accommodating housing 502 further includes a horizontal insulator 502*c* arranged horizontally and connected to the vertical insulator 502*b*.

A plurality of heating wire accommodating grooves 502*a* are defined at an upper portion and a lower portion of the vertical insulator 502*b* and extend inward from an end of the vertical insulator 502*b* to accommodate and wound the heating wire 507. The heating wire 507 is inserted into the heating wire accommodating groove 502*a* and wound in zigzag pattern, and is accommodated in the heating wire accommodating housing 502 in a coil shape.

The heating wire accommodating grooves 502*a* may have different height differences and may extend inward. The heating wire accommodating grooves 502*a* do not have a same height, but have different heights, the heating wire 507 do not have a same radius, but have different radii, and extend inward the vertical insulator 502*b* from the end of the vertical insulator 502*b*.

Figure 7:
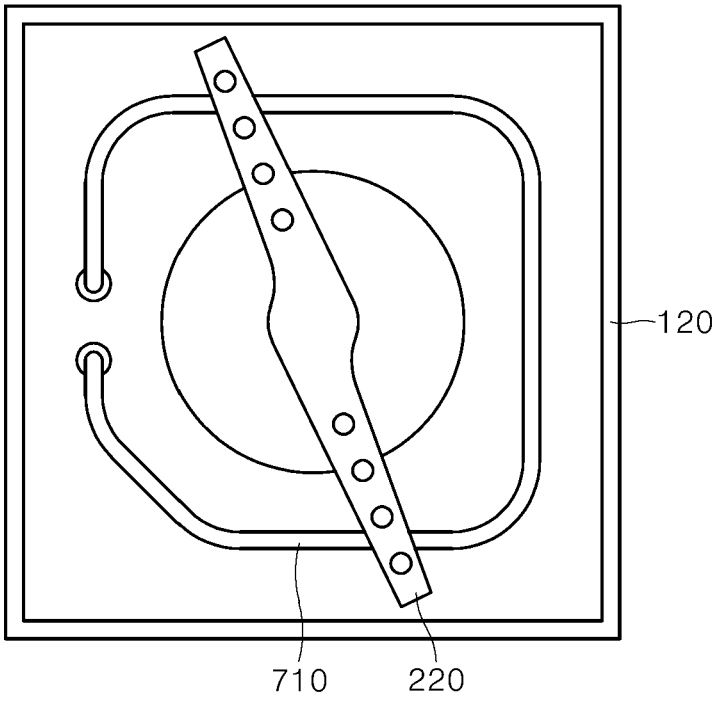
FIG. 7 is a plane view showing a drying device according to another embodiment of the present disclosure.

FIG. 7 is a plane view showing a drying device according to another embodiment of the present disclosure.

Referring to FIG. 7, the drying device may be a heating wire 710 disposed inside a washing space 121.

Specifically, a circular heating wire 710 may be disposed on a bottom of a tub 120. A temperature inside the washing space 121 is increased based on a radiant heat emitted from the heating wire 710. Based on the increased temperature, washing water present on a washing object is evaporated to dry the washing object. In this case, a first fan 414 is not disposed in the drying device.

Meanwhile, in FIG. 7, the heating wire 710 is disposed on the bottom of the tub 120, but the present disclosure is not limited thereto, and the heating wire 710 may be disposed on the ceiling of the tub 120 or inner surfaces of the tub 120.

[Process of Exhausting Humid Air in Washing Space]

When hot water generated using a first heater 2112 is used in a washing process and a rinsing process, a temperature inside a washing space 121 is increased and washing water present on a washing object is evaporated, thereby generating humid air in the washing space 121. In addition, when the drying process is performed, the temperature inside the washing space 121 is increased by a second heater 415 or a heating wire 710, the washing water present on the washing object is evaporated to dry the washing object. Based on the evaporation, humid air is generated in the washing space 121.

In this case, the humid air may be discharged for efficient execution of the drying process.

According to an embodiment of the present disclosure, the humid air in the washing space 121 may be discharged by partially opening a door 130. This is as shown in FIG. 8.

Figure 8:
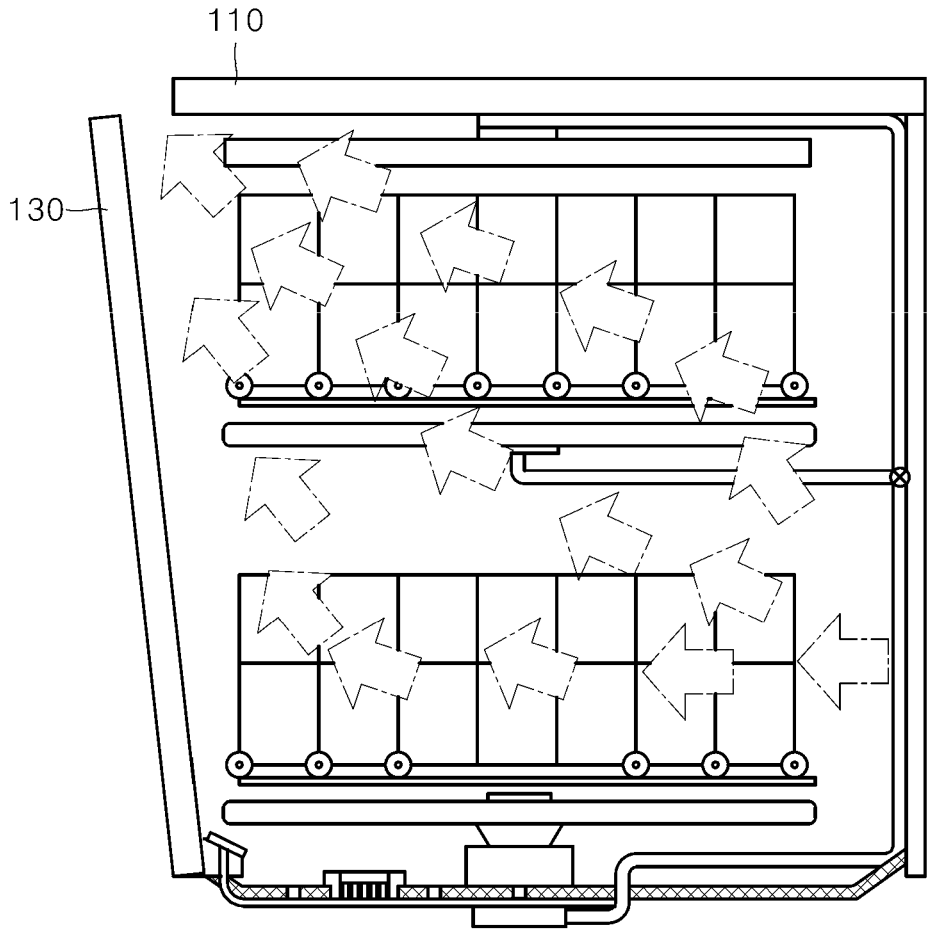
FIG. 8 shows an example of air in a washing space being discharged.

FIG. 8 shows an example of air in a washing space being discharged.

A door 130 is closed in a washing process and a rinsing process. Therefore, humid air is not discharged to outside in the washing process and the rinsing process. In addition, as shown in FIG. 8, when the drying process starts, the door 130 is partially opened at an initial time point of the drying process. That is, during the drying process, a temperature of a washing space 121 is increased by a second heater 415 and the door 130 is partially opened at a first time point to discharge the humid air.

In this case, the partial opening of the door 130 is not a manual opening operation by an external force of a user, but is an operation performed by a door driver disposed on at least a portion of the door 130 and a case 110.

When the drying process ends, a state of the door 130 is changed from the partially open state to a closed state, thereby preventing recontamination of a washed object due to dust and the like.

In addition, according to another embodiment of the present disclosure, an exhaust outlet is defined at a portion of a tub 120 or inside the door 130, and humid air in the washing space 121 may be discharged through the exhaust outlet. This configuration is as shown in FIG. 9.

Figure 9:
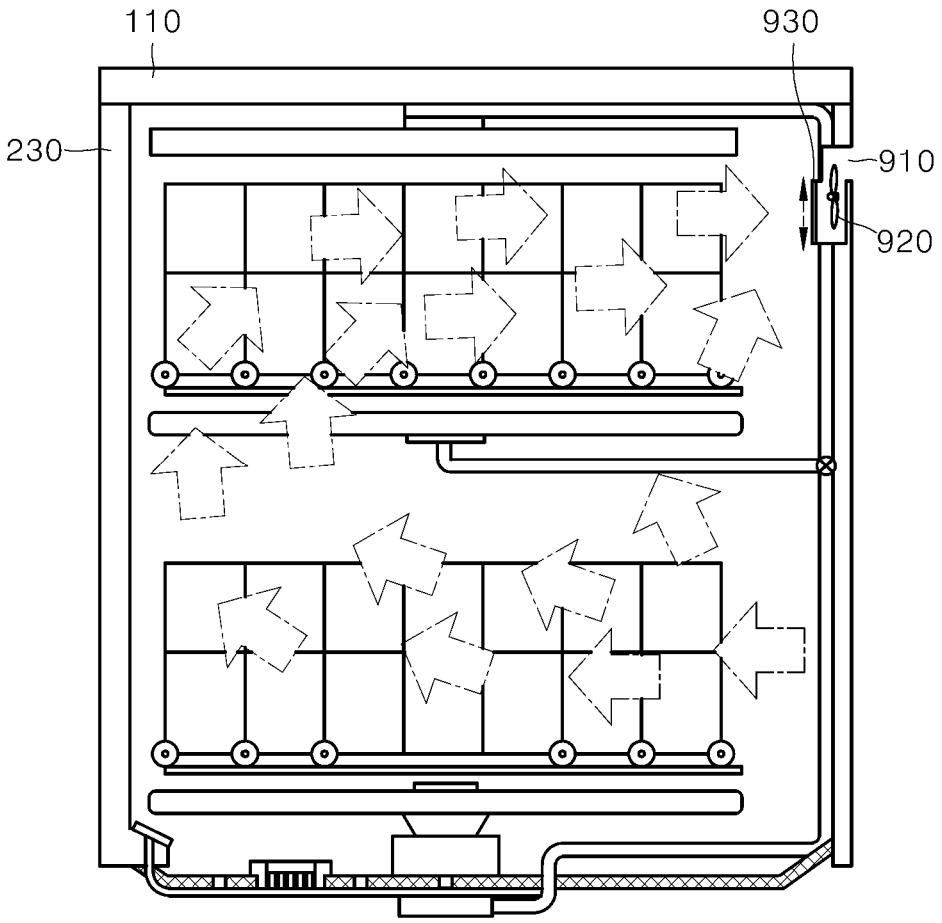
FIG. 9 shows another example of air in a washing space being discharged.

FIG. 9 shows another example of air in a washing space being discharged.

Referring to FIG. 9, an exhaust outlet 910, a second fan 920, and a cover 930 are each disposed at an upper end of a tub 120, and a dishwasher 100 does not include a door driver. In addition, the dishwasher 100 according to another embodiment of the present disclosure is the same as the dishwasher 100 according to an embodiment of the present disclosure shown in FIGS. 1 and 2, except for the exhaust outlet 910, the second fan 920, and the cover 930.

The exhaust outlet 910 exhausts the humid air inside a washing space 121 to an outside of the tub 120. The exhaust outlet 910 passes through a portion of the tub 120 to communicate an inner space of the washing space 121 with an outer space of the tub 120.

The second fan 920 is disposed inside the exhaust outlet 910 and discharges the humid air inside the washing space 121 to the outside of the tub 120. That is, more humid air inside the washing space 121 is discharged to the outside space using the second fan 920.

The cover 930 opens or closes the exhaust outlet 910. The cover 930 may be disposed at an end adjacent to an inner surface of the tub 120 among both ends of the exhaust outlet 910. However, the present disclosure is not limited thereto. The cover 930 may be operated by the motor.

When the cover 930 is closed, the humid air inside the washing space 121 is not discharged to the outside of the tub 120, and when the cover 930 is open, the humid air inside the washing space 121 is discharged to the outside of the tub 120. That is, when the cover 930 is opened, the second fan 920 is turned on and the humid air inside the washing space 121 is discharged, and when the cover 930 is closed, the second fan 920 is turned on and the humid air inside the washing space 121 is not discharged.

In this case, the cover 930 may be opened or closed and the second fan 920 may be turned on/off simultaneously or individually. When the cover 930 is opened or closed and the second fan 920 is turned on/off simultaneously, it is possible to prevent the second fan 920 from being turned on meaninglessly and reduce power consumption thereof.

Meanwhile, a motor to operate the second fan 920 and the cover 930 is not shown in FIG. 9, but may be further disposed in a dishwasher 100.

[Drying Process]

A drying process is a process of drying a washing object with washing water and includes a process of discharging air inside a washing space 121 to outside.

Hereinafter, embodiments of the drying process of a dishwasher 100 are described with reference to accompanying drawings.

Figure 10:
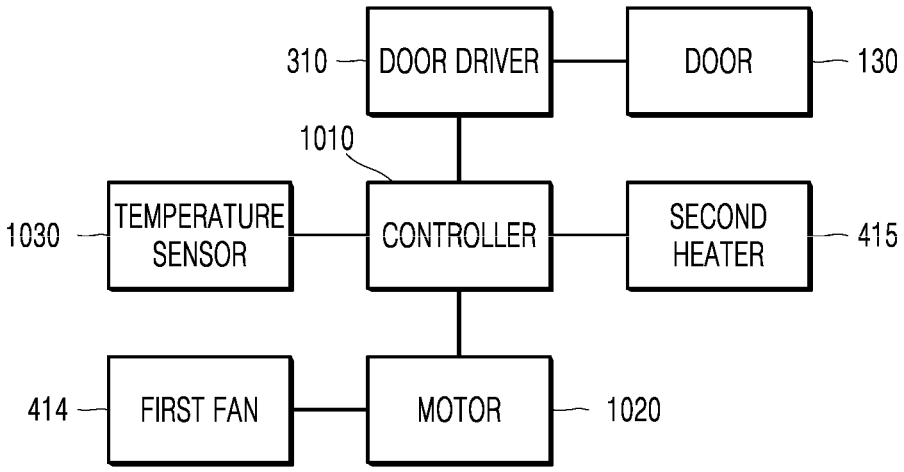
FIG. 10 is a block diagram showing an example electronic system for executing, by a dishwasher 100, a drying process.

FIG. 10 is a block diagram of an example electronic system to execute a drying process of a dishwasher 100.

FIG. 10 shows the electronic system to perform the drying process of the dishwasher 100 according to FIGS. 2, 3, 4, and 8 and may be included in the dishwasher 100.

Referring to FIG. 10, a controller 1010 controls a door driver 310, a motor 1020, and a second heater 415, and is communicatively connected to a temperature sensor 1030.

The door driver 310 controls an open/closed state of a door 130. The motor 1020 drives a first fan 414. The temperature sensor 1030 is disposed in a washing space 121 to measure a temperature of the washing space 121 and transmits temperature information to the controller 1010. The controller 1010 may be a processor-based device, for example a microcomputer.

Figure 11:
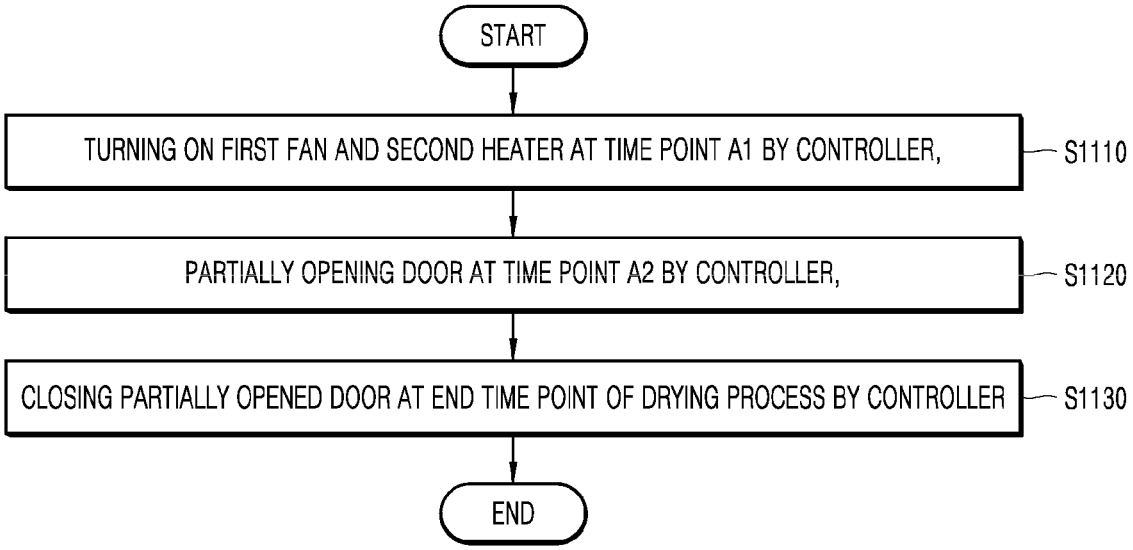
FIG. 11 is a flowchart showing a drying process by a dishwasher according to a first embodiment of the present disclosure.

FIG. 11 is a flowchart of a drying process of a dishwasher 100 according to a first embodiment of the present disclosure.

Hereinafter, each step is described in more detail with reference to FIG. 11.

The contents of the dishwasher 100 described in FIGS. 4 and 8 above may be applied to FIG. 11. In addition, it is assumed that a washing process and a rinsing process were performed before the drying process, and a door 130 is closed and a first fan 414 and a second heater 415 are turned off at an end time point of the rinsing process.

A controller 1010 turns on the first fan 414 and the second heater 415 at time point A1 (S1110).

The time point A1 may be a start time point of the drying process. That is, the controller 1010 may turn on the first fan 414 and the second heater 415 at the start time point of the drying process. However, the present disclosure is not limited thereto, and the time point A1 may be a time point close to the start time point of the drying process.

Specifically, as the first fan 414 and the second heater 415 are turned on, air outside the dishwasher 100 is introduced into a flow path duct 412 through an air inlet 411 and the introduced external air is heated by the second heater 415. The heated air is guided by the flow path duct 412 and is discharged into the washing space 121 through an air discharge outlet 413. A temperature of the washing space 121 is increased based pm the heated air and the washing object is dried.

According to an embodiment of the present disclosure, a heating level of the second heater 415 may be adjusted based on the temperature of the washing space 121. That is, the temperature sensor 1030 may measure the temperature of the washing space 121, transmit the measured temperature information to the controller 1010, and the controller 1010 may adjust the heating level of the second heater 415 at time point A1 based on the measured temperature thereof.

For example, the controller 1010 may adjust the heating level of the second heater 415 in inverse proportion to the measured temperature thereof. That is, when the temperature of the washing space 121 has a first temperature value, the heating level of the second heater 415 may be set to a first level, and when the temperature of the washing space 121 has a second temperature value that is greater than the first temperature value, the heating level of the second hater 415 may be set to a second level that is less than the first level.

Subsequently, the controller 1010 partially opens the door 130 at time point A2 (S1120).

In this case, the time point A2 is a time point after the time point A1. For example, the time point A2 may be a time point close to the start time point of the drying process. However, the present disclosure is not limited thereto.

Specifically, when the temperature of the washing space 121 increases due to the discharge of the heated air, the washing water present on the outside of the washing object evaporates, and the internal air of the washing space 121 is humidified by the evaporated air. When the humidified air is present in the washing space 121, drying efficiency thereof is reduced. To prevent the above issue, the controller 1010 controls the door driver to partially open the door 130 at the time point A2, and the humid air is discharged to the partially opened door 130.

The controller 1010 closes the partially opened door 130 at an end time point of the drying process (S1130). The washing object is prevented from being contaminated again due to the dust or the like by closing the door 130.

According to another embodiment of the present disclosure, a partially open state of the door 130 may be maintained at the end time point of the drying process. In this case, S1130 is not performed.

Hereinafter, the drying process of the dishwasher in the related art and the drying process of the dishwasher 100 according to the first embodiment of the present disclosure are compared as follows.

According to a conventional dishwasher, when the rinsing process ends, the door that was closed is partially opened at the start of the drying process, and then the fan and the heater turns on. In this case, the temperature of the washing space is reduced by partially opening the door and efficiency of the drying process is reduced based on the reduced temperature of the washing space. Moreover, since the heater is preheated while the door is partially opened, as the preheating time increases, the amount of the external air flowing into the partially opened door increases. Accordingly, the temperature of the washing space is further reduced.

That is, the dishwasher in the related art has the reduced efficiency of the drying process, lengthens the execution time period of the drying process, lengthens a driving time period of the heater to increase the temperature of the washing space, and consumes a lot of power to drive the heater.

According to the first embodiment of the present disclosure, the dishwasher 100 turns on the first fan 414 and the second heater 415 to introduce external air, and heat the introduced external air at the time point A1 (e.g., the start time point thereof) and partially opens the door 130 to discharge the humid air at the time point A2 after the time point A1.

That is, the first fan 414 and the second heater 415 are turned on, and in particular, the second heater 415 is preheated before the door 130 is partially opened, thereby maintaining the temperature of the washing space 121 at an appropriate temperature and increasing the efficiency of the drying process. In addition, the driving time period of the second heater 415 is shorter than that of the dishwasher in the related art due to the maintained temperature of the washing space 121, thereby reducing the power to drive the second heater 415. In addition, the execution time period of the drying process is shortened than that of the dishwasher in the related art based on the maintained temperature of the washing space 121. In addition, the dishwasher has a simple structure and uses a simple control method to discharge the humid air present in the washing space, thereby blocking condensation of the water on the surface of the washing object or the wall of the tub.

Meanwhile, the contents described in FIG. 11 may be similarly applied to the dishwasher 100 including a drying device according to another embodiment of the present disclosure shown in FIG. 7.

That is, the controller 1010 turns on a heating wire 710 at the time point A1, partially opens the door 130 at the time point A2, and closes the door 130 at the end time point of the drying process. In other words, "turning on the heating wire 710 at the time point A1" may correspond to "turning on the first fan 414 and the second heater 415 at the time point A1" described above, and the remaining steps are the same as those of FIG. 11.

In addition, the contents described with reference to FIG. 11 may be similarly applied to the dishwasher 100 according to another embodiment of the present disclosure shown in FIG. 9.

That is, the controller 1010 turns on the first fan 414 and the second heater 415 at the time point A1, turns on the second fan 920 and opens the cover 930 at the time point A2, and turns off the second fan 920 and closes the cover 930 at the end time point of the drying process. In other words, "turning on the second fan 920 and opening the cover 930 at the time point A2" corresponds to "partially opening the door 130 at the time point A2" described above, "turning off the second fan 920 and closing the cover 930 at the end time point of the drying process" corresponds to "closing the door 130 at the end time point of the drying process" described above, and the remaining steps are the same as those of FIG. 11.

Figure 12:
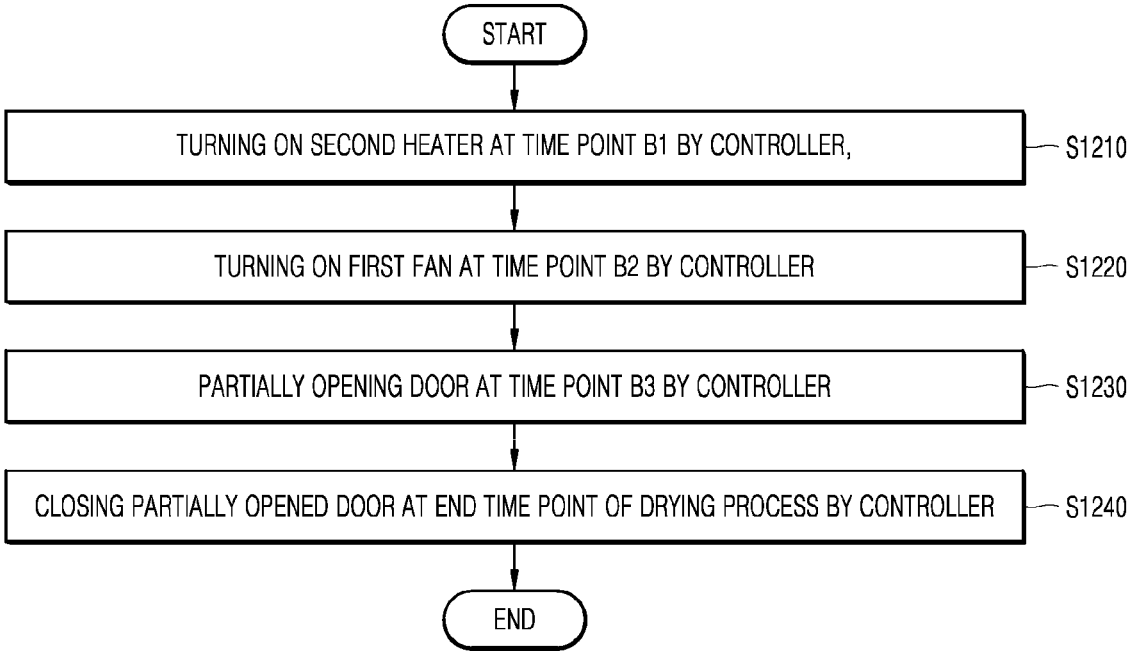
FIG. 12 is a flowchart showing a drying process by a dishwasher according to a second embodiment of the present disclosure.

FIG. 12 is a flowchart of a drying process of a dishwasher 100 according to a second embodiment of the present disclosure.

Hereinafter, each step is described in more detail with reference to FIG. 12.

The contents of the dishwasher 100 described with reference to FIGS. 4 and 8 may be applied to FIG. 12. In addition, it is assumed that a washing process and a rinsing process were performed before the drying process, and the door 130 is closed and a first fan 414 and the second heater 415 are turned off during an end time point of the rinsing process.

The controller 1010 turns on the second heater 415 at time point B1 (S1210).

Subsequently, the controller 1010 turns on the first fan 414 at time point B2 (S1220).

In this case, the time point B1 may be a start time point of the drying process. In addition, the time point B2 is a time point after the time point B1. In addition, a heating level of the second heater 415 at the time point B1 may be adjusted based on the temperature of the washing space 121. This configuration is similar to that described with reference to FIG. 11 above. However, the present disclosure is not limited thereto.

Specifically, the second heater 415 is turned on at the time point B1 and may be preheated. That is, a time period between the time point B1 and the time point B2 may be a time period for which the second heater 415 is preheated. Subsequently, the first fan 414 is turned on at the time point B2 to introduce external air of the dishwasher 100 into a flow path duct 412 through an air inlet 411. The introduced external air is heated by the second heater 415 and is discharged into the washing space 121. A temperature of the washing space 121 is increased based on the heated air to dry the washing object.

Subsequently, the controller 1010 partially opens the door 130 at time point B3 (S1230).

In this case, the time point B3 is a time point after the time point B2. Washing water present on the outside of the washing object evaporates based on the discharge of the heated air and the air inside the washing space 121 humidified by the evaporated air is discharged through the partially opened door 130.

Subsequently, the controller 1010 closes the partially opened door 130 at an end time point of the drying process (S1240). Due to the closing of the door 130, the washing object to be cleaned is not contaminated again.

According to another embodiment of the present disclosure, the partially open state of the door 130 may be maintained at the end time point of the drying process. In this case, S1240 is not performed.

In short, the dishwasher 100 according to the second embodiment of the present disclosure turns on the second heater 415 at time point B1 (e.g., a start time point thereof) to preheat the second heater 145, turns on the first fan 414 at the time point B2 after the time point B1 to introduce external air, and partially opens the closed door 130 at the time point B3 after the time point B2 to discharge the humid air.

That is, similar to FIG. 11, the first fan 414 and the second heater 415 are turned on, and in particular, the second heater 415 is preheated or heated before the door 130 is partially opened. In particular, the dishwasher 100 according to the second embodiment of the present disclosure turns on the first fan 414 later than the dishwasher 100 according to the first embodiment of the present disclosure.

As the first fan 414 is turned on later, the external air may not flow into the washing space 121 for that time period. In this case, the temperature of the washing space 121 may be reduced more slowly. In addition, similar to the dishwasher 100 according to the first embodiment of the present disclosure, the dishwasher 100 according to the second embodiment of the present disclosure also maintains the temperature of the washing space 121 at an appropriate temperature, increases the efficiency of the drying process, shortens the driving time period of the second heater 415 than that of the dishwasher in the related art, reduces a power to drive the second heater 415, and shortens the execution time period of the drying process.

The contents described in FIG. 12 may be similarly applied to the dishwasher 100 according to another embodiment of the present disclosure shown in FIG. 9.

That is, the controller 1010 turns on the second heater 415 at the time point B1, turns on the first fan 414 at the time point B2, and turns on the second fan 920 and opens the cover 930 at the time point B3, and turns off the second fan 920 and closes the cover 930 at the end time point of the drying process. In other words, "turning on the second fan 920 and opening the cover 930 at the time point B3" corresponds to "partially opening the door 130 at the time point B3" described above, "turning off the second fan 920 and closing the cover 930 at the end time point of the drying process" corresponds to "closing the door 130 at the end time point of the drying process" described above, and the remaining steps are the same as those of FIG. 12.

Figure 13:
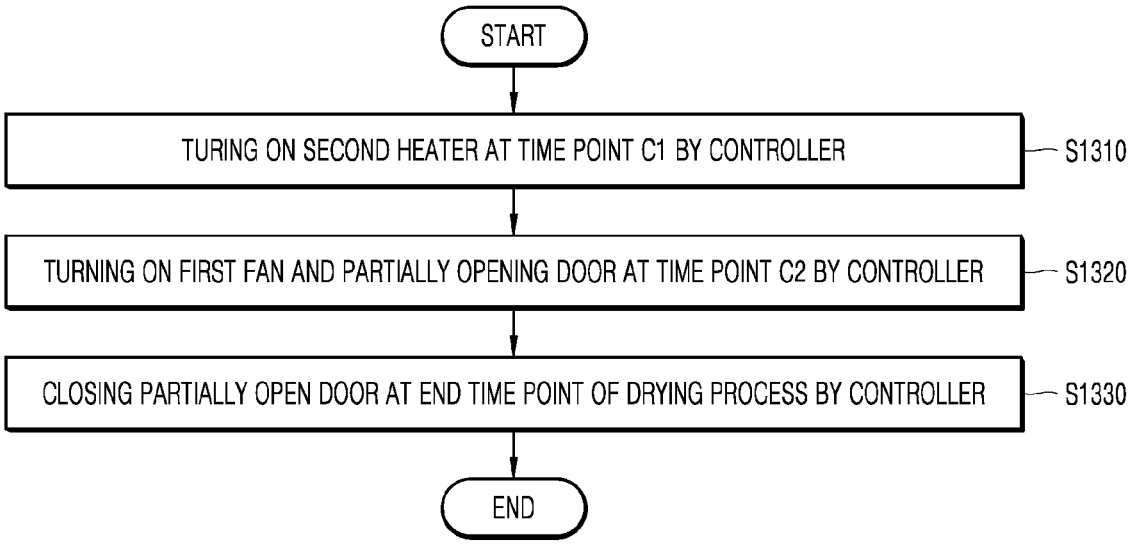
FIG. 13 is a flowchart showing a drying process by a dishwasher according to a third embodiment of the present disclosure.

FIG. 13 is a flowchart of a drying process of a dishwasher 100 according to a third embodiment of the present disclosure.

Hereinafter, each step is described in more detail with reference to FIG. 13.

The contents of the dishwasher 100 described with reference to FIGS. 4 and 8 may be applied to FIG. 13. In addition, it is assumed that a washing process and a rinsing process were performed before a drying process, a door 130 is closed and a first fan 414 and a second heater 415 are turned off at an end time point of the rinsing process.

A controller 1010 turns on the second heater 415 at time point C1 (S1310).

In this case, the time point C1 may be a start time point of the drying process. In addition, a heating level of the second heater 415 at the time point C1 may be adjusted based on a temperature of the washing space 121. This configuration is similar to that described in FIG. 11 above. However, the present disclosure is not limited thereto.

Subsequently, the controller 1010 turns on the first fan 414 and partially opens the door 130 at time point C2 (S1320). In this case, the time point C2 is a time point after the time point C1.

Specifically, the second heater 415 is turned on at the time point C1 and may be preheated. That is, a time period between the time point C1 and the time point C2 may be a time period for which the second heater 415 is preheated. Subsequently, the first fan 414 is turned on and the door 130 is partially opened at the time point C2. In this case, at the time point C2, air outside a dishwasher 100 is introduced, is heated by the second heater 415, and washing water present on an outside of a washing object evaporates based on the discharge of the heated air, and the inner air of the washing space 121 humidified based on the evaporated air is discharged to the partially opened door 130.

Subsequently, the controller 1010 closes the partially opened door 130 at an end time point of a drying process (S1330).

According to another embodiment of the present disclosure, the partially open state of the door 130 may be maintained at the end time point of the drying process. In this case, S1330 is not performed.

In short, the dishwasher 100 according to the third embodiment of the present disclosure turns on the first fan 414 and partially opens the door 130 later than the turn-on of the second heater 415. Therefore, the dishwasher 100 according to the third embodiment of the present disclosure also maintains the temperature of the washing space 121 at an appropriate temperature, increases the efficiency of the drying process, shortens a driving time period of the second heater 415 than the dishwasher in the related art, reduces a power to drive the second heater 415, and shortens an execution time period of the drying process similar to the dishwasher 100 according to the second embodiment of the present disclosure. In particular, the first fan 414 is turned on and the door 130 is partially opened, thereby slowing reducing the temperature of the washing space 121.

The contents described in FIG. 13 may be similarly applied to the dishwasher 100 according to another embodiment of the present disclosure shown in FIG. 9.

That is, the controller 1010 turns on the second heater 415 at the time point C1, turns on the first fan 414 and the second fan 920 and opens the cover 930 at the time point C2, and turns off the second fan 920 and closes the cover 930 at an end time point of the drying process. In other words, "turning on the second fan 920 and opening the cover 930 at the time point C2" corresponds to "partially opening the door 130 at the time point C2" described above, "turning off the second fan 920 and closing the cover 930 at the end time point of the drying process" corresponds to "closing the door 130 at the end time point of the drying process" described above, and the remaining steps are the same as those of FIG. 13.

Figure 14:
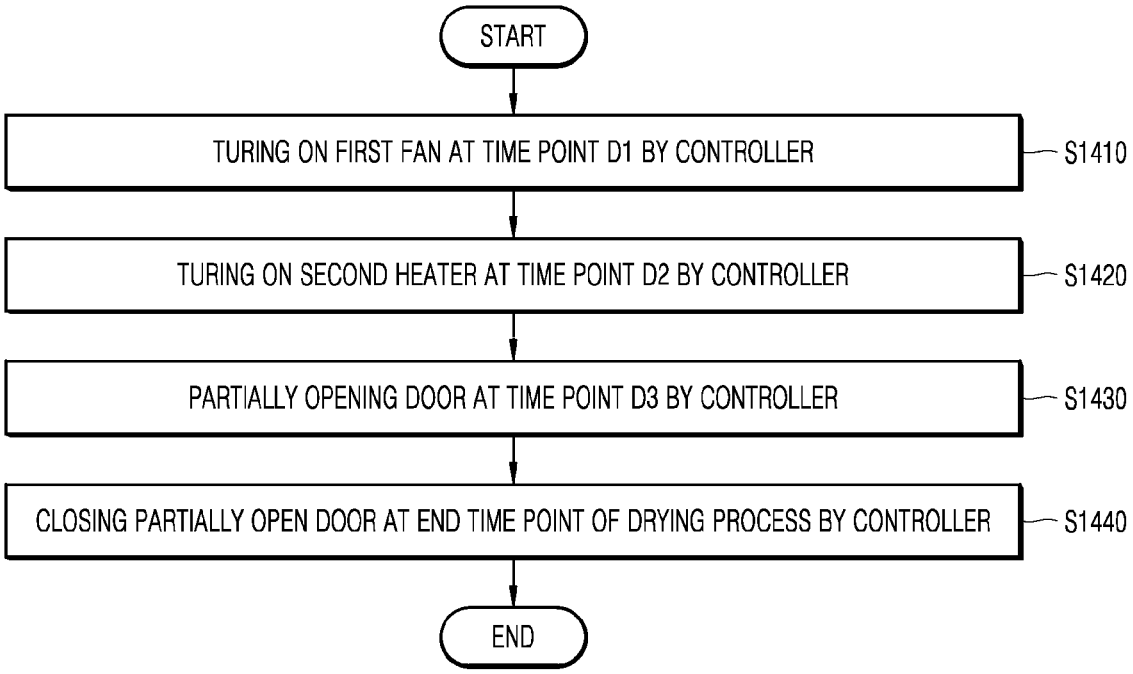
FIG. 14 is a flowchart showing a drying process by a dishwasher according to a fourth embodiment of the present disclosure.

FIG. 14 is a flowchart of a drying process of a dishwasher 100 according to a fourth embodiment of the present disclosure.

Hereinafter, each step is described in more detail with reference to FIG. 14.

The contents of the dishwasher 100 described in FIGS. 4 and 8 may be applied to FIG. 14. In addition, it is assumed that a washing process and a rinsing process were performed before the drying process and a door 130 is closed and a first fan 414 and a second heater 415 are turned off at an end time point of the rinsing process.

A controller 1010 turns on the first fan 414 at time point D1 (S1410).

Subsequently, the controller 1010 turns on the second heater 415 at time point D2 (S1420).

In this case, the time point D1 may be a start time point of the drying process. In addition, the time point D2 is a time point after the time point D1. In addition, a heating level of the second heater 415 at the time point D2 may be adjusted based on a temperature of the washing space 121. This is similar to that described in FIG. 11 above. However, the present disclosure is not limited thereto.

Subsequently, the controller 1010 partially opens the door 130 at time point D3 (S1430). In this case, the time point D3 is a time point after the time point D2.

Specifically, the second heater 415 is turned on at the time point D2 and may be preheated. That is, a time period between the time point D2 and the time point D3 may be a time period for which the second heater 415 is preheated. Subsequently, the door 130 is partially opened at the time point D3. Air outside the dishwasher 100 is introduced at the time point D1, the introduced air is heated by the second heater 415 at the time point D2, washing water present on the outside of the washing object is evaporated based on the discharging of the heated air, and the inner air of the washing space 121 humidified based on the evaporated air is discharged through the partially open door 130 at the time point D3.

Subsequently, the controller 1010 closes the partially opened door 130 at an end time point of the drying process (S1440).

According to another embodiment of the present disclosure, the partially open state of the door 130 may be maintained at the end time point of the drying process. In this case, S1440 is not performed.

In short, according to the fourth embodiment of the present disclosure, the dishwasher 100 partially opens the door 130 later than the turn-on of the first fan 414 and the turn-on of the second heater 415. Therefore, similar to the dishwasher 100 according to the second embodiment of the present disclosure, the dishwasher 100 according to the fourth embodiment of the present disclosure also maintains the temperature of the washing space 121 at an appropriate temperature, increases the efficiency of the drying process, shortens the driving time period of the second heater 415 than the dishwasher in the related art, reduces the power to drive the second heater 415, and shortens an execution time period of the drying process.

The contents described with reference to FIG. 14 may be similarly applied to the dishwasher 100 according to another embodiment of the present disclosure shown in FIG. 9.

That is, the controller 1010 turns on the first fan 414 at the time point D1, turns on the second heater 415 at the time point D2, turns on the second fan 920 and opens the cover 930 at the time point D3, and turns off the second fan 920 and closes the cover 930 at the end time point of the drying process. In other words, "turning on the second fan 920 and opening the cover 930 at the time point D3" corresponds to "partially opening the door 130 at the time point D3" described above, "turning off the second fan 920 and closing the cover 930 at the end time point of the drying process" corresponds to "closing the door 130 at the end time point of the drying process" described above, and the remaining steps are the same as those of FIG. 14.

Figure 15:
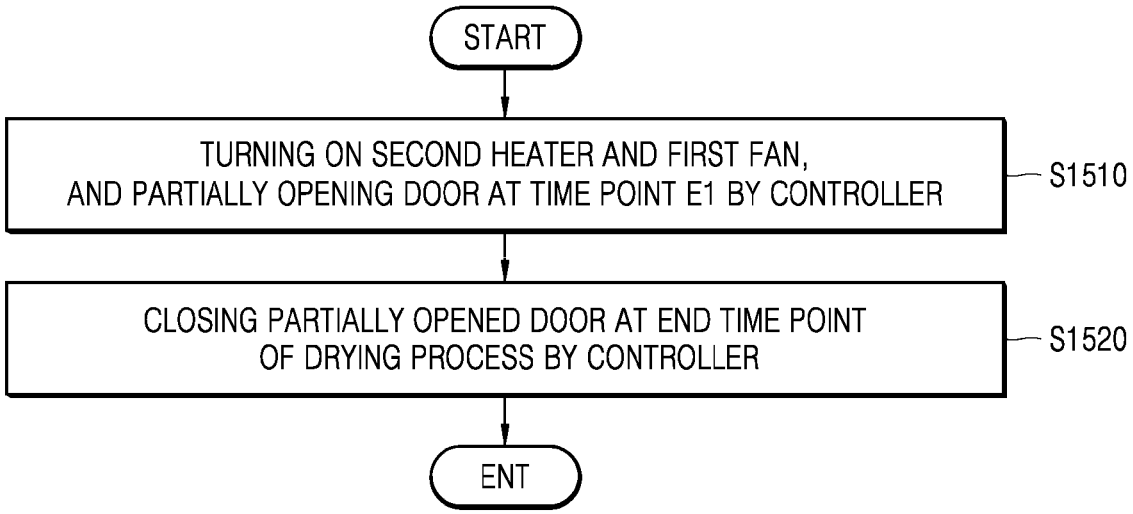
FIG. 15 is a flowchart showing a drying process by a dishwasher according to a fifth embodiment of the present disclosure.

FIG. 15 is a flowchart of a drying process of a dishwasher 100 according to a fourth embodiment of the present disclosure.

Hereinafter, each step is described in more detail with reference to FIG. 15.

The contents of the dishwasher 100 described in FIGS. 4 and 8 may be applied to FIG. 15. In addition, it is assumed that a washing process and a rinsing process were performed before the drying process, a door 130 is closed and a first fan 414 and a second heater 415 are turned off at an end time point of the rinsing process.

A controller 1010 controls a first fan 414 to be turned on, controls a second heater 415 to be turned on, and controls a door 130 to be partially opened at time point E1 (S1510).

In this case, the time point E1 may be a start time point of the drying process. In addition, a heating level of the second heater 415 at the time point D1 may be adjusted based on a temperature of a washing space 121. This is similar to that described in FIG. 11 above. However, the present disclosure is not limited thereto.

The controller 1010 closes the partially opened door 130 at an end time point of the drying process (S1520).

According to another embodiment of the present disclosure, a partially open state of the door 130 may be maintained at the end time point of the drying process. In this case, S1520 is not performed.

In short, according to the fourth embodiment of the present disclosure, the dishwasher 100 controls the door 130 to be partially opened, the first fan 414 to be turned on, and the second heater 415 to be turned on. Based on the operations, control of the drying process of the dishwasher 100 is simplified. In addition, the second heater 415 is turned on before the air is not discharged by partially opening the door 130, thereby maintaining the temperature of the washing space 121 at an appropriate temperature, the efficiency of the drying process is improved, the driving time period of the second heater 415 is shortened than that of the dishwasher in the related art, the power to drive the second heater 415 is reduced, and the execution time period of the drying process is shortened.

The contents described with reference to FIG. 15 may be similarly applied to the dishwasher 100 according to another embodiment of the present disclosure shown in FIG. 9.

That is, the controller 1010 turns on the first fan 414, the second heater 415, the second fan 920, and opens the cover 930 at the time point E1 and subsequently turns off the second fan 920 and closes the cover 930 at the end time point of the drying process. In other words, "turning on the second fan 920 and opening the cover 930 at the time point E1" corresponds to "partially opening the door 130 at the time point E1" described above, "turning off the second fan 920 and closing the cover 930 at the end time point of the drying process" corresponds to "closing the door 130 at the end time point of the drying process" described above, and the remaining steps are the same as those of FIG. 15.

Figure 16:
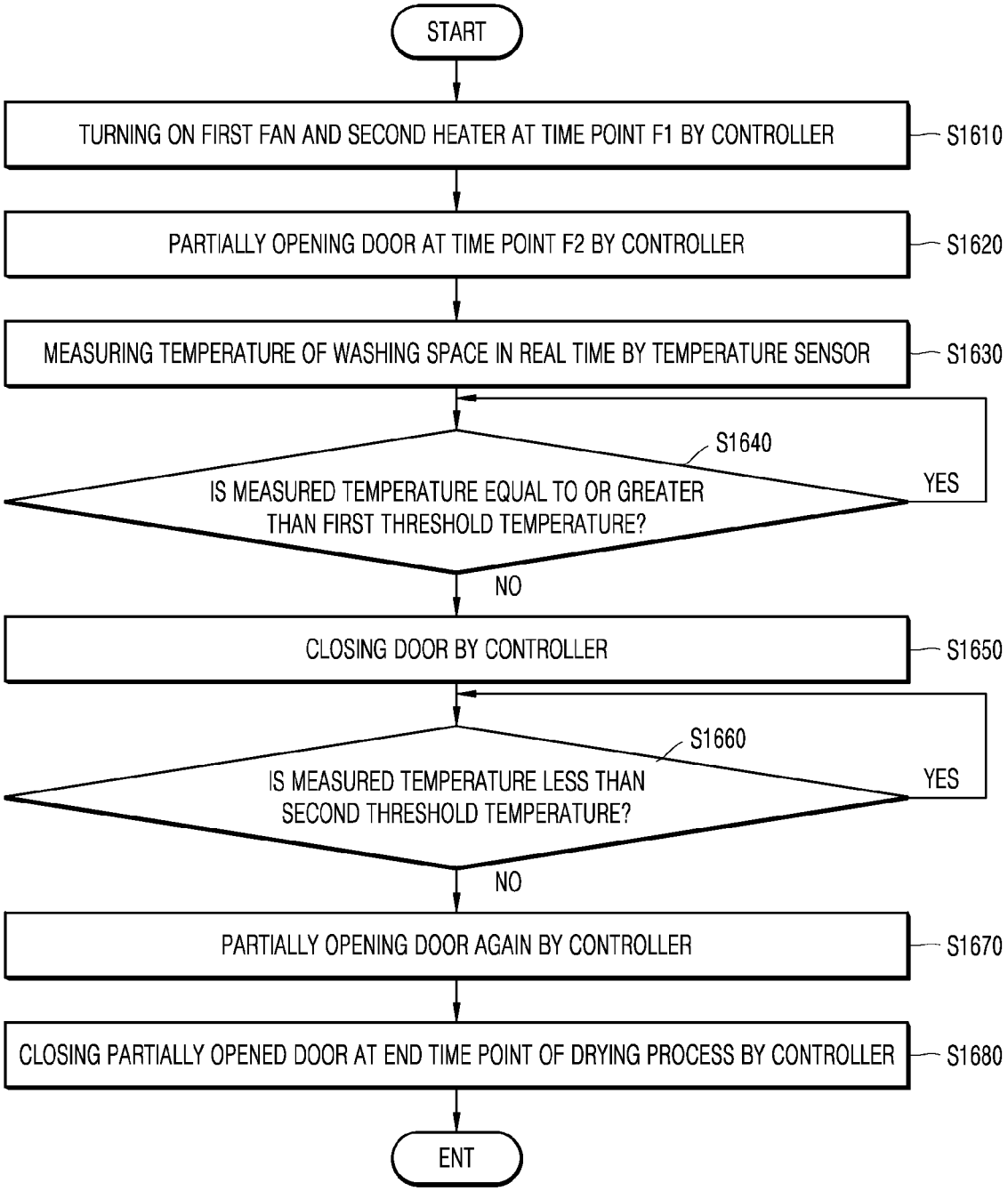
FIG. 16 is a flowchart showing a drying process by a dishwasher according to a sixth embodiment of the present disclosure.

FIG. 16 is a flowchart of a drying process of a dishwasher 100 according to a sixth embodiment of the present disclosure.

Hereinafter, each step is described in more detail with reference to FIG. 16.

The contents of the dishwasher 100 described in FIGS. 4 and 8 may be applied to FIG. 16. In addition, it is assumed that a washing process and a rinsing process were performed before the drying process, a door 130 is closed and a first fan 414 and a second heater 415 are turned off at an end time point of the rinsing process.

The controller 1010 turns on the second heater 415 and the first fan 414 at time point F1 (S1610). In this case, the time point F1 may be a start time point of the drying process.

Subsequently, the controller 1010 partially opens the door 130 at time point F2 (S1620). In this case, the time point F2 is a time point after the time point F1.

S1610 and S1620 are the same as S1110 and S1120 of FIG. 11 described above, so a detailed description thereof is omitted.

Subsequently, a temperature sensor 1030 measures a temperature of a washing space 121 in real time from the time point F2 (S1630). The measured temperature information is transmitted to the controller 1010.

It is assumed that a heating level of the second heater 415 from S1630 to S1680 is the same as a heating level of the second heater 415 at the time point F1.

Subsequently, the controller 1010 determines the measured temperature as a temperature equal to or higher than a first threshold temperature or a temperature less than a first threshold temperature (S1640).

In this case, the first threshold temperature refers to a temperature having a threshold value related to a drying efficiency of the drying process.

Based on the measured temperature being equal to or higher than the first threshold temperature, S1640 is performed again. In this case, the door 130 maintains a partially open state.

That is, based on the measured temperature being equal to or higher than the first threshold temperature, the washing object is efficiently dried, and the door 130 is partially opened to dry the washing object more efficiently.

In contrast, based on the measured temperature being less than the first threshold temperature, the controller 1010 closes the door 130 (S1650). That is, the controller 1010 controls a door driver to close the door 130.

Specifically, based on the measured temperature being less than the first threshold temperature, the temperature of the washing space 121 is too low to properly evaporate the washing water present on the washing object. In this case, the washing object is not properly dried, which causes inconvenience for a user using the dishwasher 100. To prevent the inconvenience, the controller 1010 closes the partially opened door 130, thereby increasing the temperature of the washing space 121.

Subsequently, the controller 1010 determines the measured temperature as a temperature less than a second threshold temperature or a temperature equal to or higher than a second threshold temperature (S1660).

In this case, the second threshold temperature also refers to a temperature having a threshold value related to the drying efficiency of the drying process. That is, the second threshold temperature has a reference value when the closed door 130 is opened again and is greater than the first threshold temperature.

S1660 is performed again based on the measured temperature being less than the second threshold temperature. In this case, the door 130 maintains the closed state.

That is, when the measured temperature is less than the second threshold temperature, the temperature of the washing space 121 has to be increased, and the door 130 is closed to increase the temperature of the washing space 121.

In contrast, based on the measured temperature being the same as the second threshold temperature, the controller 1010 partially opens the door 130 again (S1670). That is, the controller 1010 controls a door driver to partially open the door 130. In this case, humid air in the washing space 121 is discharged.

In FIG. 16, it is assumed that the operation of closing and reopening the door 130 based on the first threshold temperature and the second threshold temperature is performed once, but may be performed twice or more.

Finally, the controller 1010 closes the partially opened door 130 at an end time point of the drying process (S1680). The door 130 is closed, thereby preventing recontamination of the washing object that has washed due to dust and the like.

According to another embodiment of the present disclosure, a partially open state of the door 130 may be maintained at the end time point of the drying process. In this case, S1680 is not performed.

In short, the opening or closing state of the door 130 may be adjusted based on the temperature of the washing space 121 measured at a time point after the time point when the door 130 is partially opened and the discharge of the air inside the washing space 121 may be controlled.

The contents described in FIG. 16 may be similarly applied to the dishwasher 100 including a drying device according to another embodiment of the present disclosure shown in FIG. 7. That is, the controller 1010 may control a heating wire 710 to be turned on at the time point F1 and control the door 130 to be partially opened at the time point F2.

In addition, the contents described with reference to FIG. 16 may be similarly applied to the dishwasher 100 according to another embodiment of the present disclosure shown in FIG. 9. That is, "partially opening the door 130" may correspond to "turning on the second fan 920 and opening the cover 930".

In addition, the contents described with reference to FIG. 16 may be similarly applied to the drying process according to the second to fifth embodiments of the present disclosure shown in FIGS. 12 to 15. That is, S1610 and S1620 of the drying process according to the sixth embodiment of the present disclosure may be replaced with S1210 to S1230 of the drying process according to the second embodiment of the present disclosure, may be replaced with S1310 and S1320 of the drying process according to the third embodiment of the present disclosure, may be replaced with S1410 to S1430 of the drying process according to the fourth embodiment of the present disclosure, and may be replaced with S1510 of the drying process according to the fifth embodiment of the present disclosure.

Figure 17:
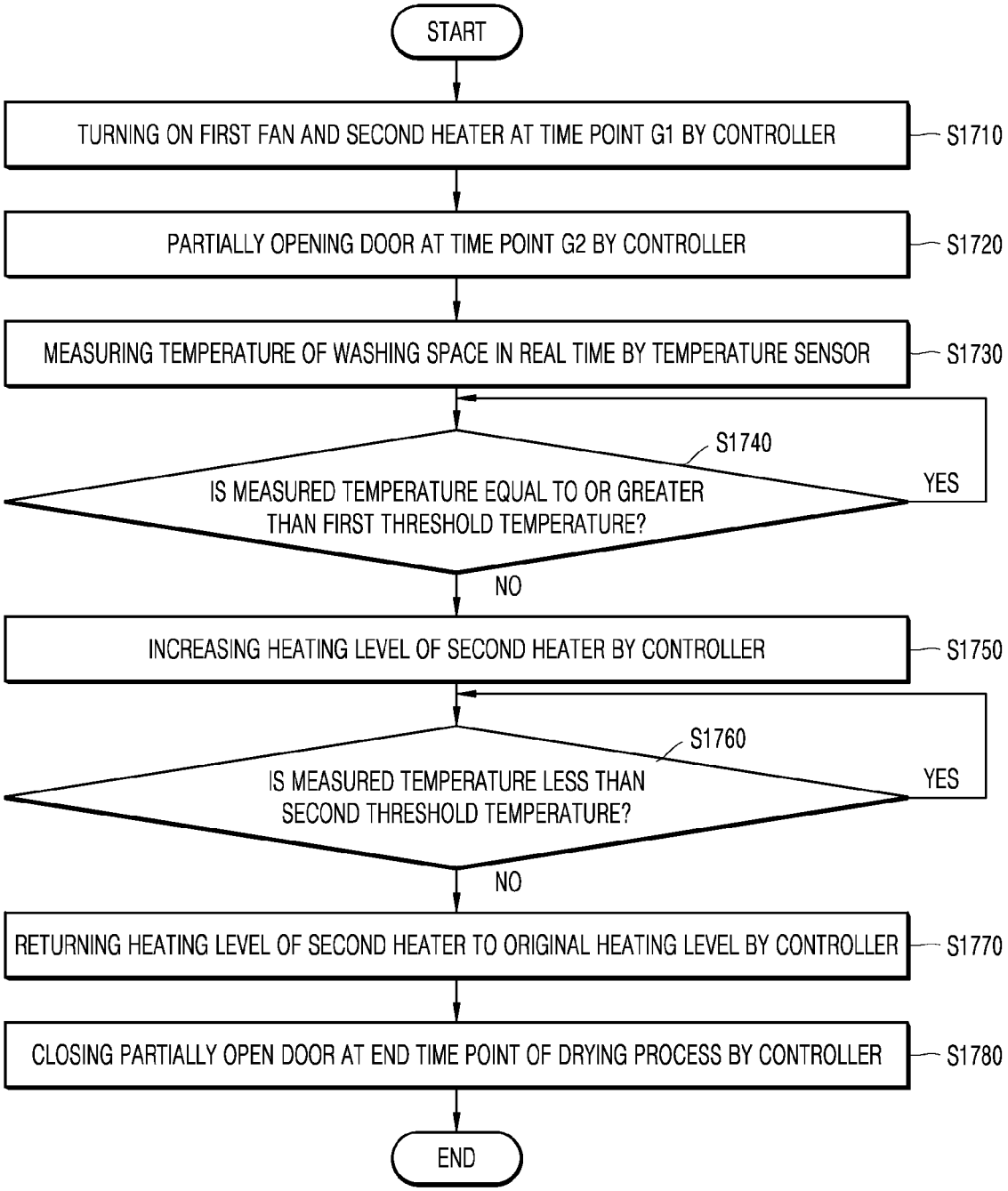
FIG. 17 is a flowchart showing a drying process by a dishwasher according to a seventh embodiment of the present disclosure.

FIG. 17 is a flowchart of a drying process of a dishwasher 100 according to a seventh embodiment of the present disclosure.

Hereinafter, each step is described in more detail with reference to FIG. 17.

The contents of the dishwasher 100 described in FIGS. 4 and 8 may be applied to FIG. 17. In addition, it is assumed that a washing process and a rinsing process were performed before the drying process, a door 130 is closed and a first fan 414 and a second heater 415 are turned off at an end time point of the rinsing process.

A controller 1010 turns on the second heater 415 and the first fan 414 at time point G1 (S1710). In this case, the time point G1 may be a start time point of the drying process. In addition, the second heater 415 may be turned on at a first heating level.

Subsequently, the controller 1010 partially opens the door 130 at time point G2 (S1720). In this case, the time point G2 is a time point after the time point G1.

The door 130 is partially opened from the time point G2 to an end time point of the drying process.

Subsequently, a temperature sensor 1030 measures a temperature of a washing space 121 in real time from the time point G2 (S1730). The measured temperature information is transmitted to the controller 1010.

The controller 1010 compares the measured temperature with a first threshold temperature (S1740).

S1710 to S1740 are similar to S1610 to S1640 of FIG. 16 described above, so a detailed description thereof is omitted.

Based on the measured temperature being equal to or higher than the first threshold temperature, S1740 is performed again. That is, based on the measured temperature being equal to or higher than the first threshold temperature, the washing object is efficiently dried.

In contrast, based on the measured temperature being less than the first threshold temperature, the controller 1010 increases a heating level of the second heater 415 (S1750).

That is, based on a heating level of the second heater 415 at S1710 being the first heating level and the measured temperature being less than the first threshold temperature, the heating level of the second heater 415 may be adjusted to a second heating level that is greater than the heating level.

Specifically, based on the measured temperature being less than the first threshold temperature, the temperature of the washing space 121 is too low to properly evaporate the washing water present on the washing object. In this case, the washing object is not properly dried. The controller 1010 increases the heating level of the second heater 415, thereby increasing the temperature of the washing space 121 increases.

Subsequently, the controller 1010 compares the measured temperature with a second threshold temperature (S1760).

In this case, the second threshold temperature has a reference value to adjust a heating level of the second heater 415 and is greater than the second threshold temperature.

Based on the measured temperature being less than the second threshold temperature, S1760 is performed again. That is, when the measured temperature is less than the second threshold temperature, the temperature of the washing space 121 has to be increased, and for the temperature increase, the heating level of the second heater 415 is maintained at a second heating level.

In contrast, based on the measured temperature being the same as the second threshold temperature, the controller 1010 returns the heating level of the second heater 415 to an original heating level (S1770). That is, the controller 1010 returns the heating level of the second heater 415 from the second heating level to the first heating level.

When the measured temperature is the same as the second threshold temperature, further increase in the temperature of the washing space 121 is meaningless, and unnecessary power consumption occurs. In this case, the controller 1010 adjusts the heating level of the second heater 415 to the first heating level.

In FIG. 17, it is assumed that the heating level adjustment operation of the second heater 415 based on the first threshold temperature and the second threshold temperature is performed once, but may be performed twice or more.

Finally, the controller 1010 closes the partially opened door 130 at an end time point of the drying process (S1780). The door 130 is closed, thereby preventing recontamination of the washed object due to the dust and the like.

According to another embodiment of the present disclosure, a partially open state of the door 130 may be maintained at the end time point of the drying process. In this case, S1780 is not performed.

In short, a heating level of the second heater 415 may be adjusted based on the temperature of the washing space 121 measured at a time point after the time point when the door 130 is partially opened.

Meanwhile, the contents described with reference to FIG. 17 may be similarly applied to the dishwasher 100 including a drying device according to another embodiment of the present disclosure shown in FIG. 7. That is, the controller 1010 may turn on the heating wire 710 at the time point G1 and partially opens the door 130 at the time point G2.

In addition, the contents described with reference to FIG. 17 may be similarly applied to the dishwasher 100 according to another embodiment of the present disclosure shown in FIG. 9. That is, "partially opening the door 130" may correspond to "turning on the second fan 920 and opening the cover 930".

In addition, the contents described with reference to FIG. 17 may be similarly applied to the drying process according to the second to fifth embodiments of the present disclosure shown in FIGS. 12 to 15. That is, S1710 and S1720 of the drying process according to the seventh embodiment of the present disclosure may be replaced with S1210 to S1230 of the drying process according to the second embodiment of the present disclosure, may be replaced with S1310 and S1320 of the drying process according to the third embodiment of the present disclosure, may be replaced with S1410 to S1430 of the drying process according to the fourth embodiment of the present disclosure, and may be replaced with S1510 of the drying process according to the fifth embodiment of the present disclosure.

In addition, the content described in FIG. 16 and the content described in FIG. 17 may be performed in combination with each other.

All components in the embodiments of the present disclosure are described as being combined to one, or as being coupled to operate; however, the present disclosure is not necessarily limited to the embodiments, and all components may be selectively combined to one or more and coupled to operate within the purpose scope of the present disclosure. Further, all of the components may be implemented as an independent hardware or a portion or all of the components may be selectively combined and implemented as a computer program including a program module to perform a part or all of the functions combined with one or a lot of hardware. Codes and code segments of the computer program can be easily deduced by those skilled in the art of the present disclosure. The computer program may be stored in computer-readable media that can be read by a computer and may be read and implemented by the computer to implement the embodiment of the present disclosure. The storage medium of the computer program includes a magnetic recording medium, an optical recording medium, and a semiconductor recording element. Further, the computer program to implement the embodiment of the present disclosure may include a program that is transmitted in real time through an external device.

The present disclosure has been mainly described with reference to the exemplary drawings hereinabove; however, the present disclosure is not limited to the embodiments and the drawings set forth herein and various modifications can be made by those skilled in the art within the scope of the technical idea of the present disclosure. In addition, even if working effects obtained based on the configurations of the present disclosure are not explicitly described, predictable effects thereof also have to be recognized based on the corresponding configurations.

Other implementations are within the scope of the following claims.

What is claimed is:

1. A dishwasher, comprising:

a tub defining a washing space;

a door disposed at a front surface of the tub and configured to open or close the washing space;

a rack disposed in the tub and configured to accommodate a washing object;

a heater configured to increase a temperature inside the washing space;

a door actuator configured to partially open the closed door or close the partially opened door;

a first fan configured to provide outside air to the heater; and a controller configured to control the door actuator to partially open the door at a first time point of a drying process of the washing object, wherein the heater is configured to be turned on at a time point of the drying process before the first time point, wherein the controller is configured to measure the temperature of the washing space at an end time point of a rinsing process and, based on the temperature of the washing space, to adjust a heating level of the heater that is turned on at the time point before the first time point, wherein the rinsing process of the washing object is performed before the drying process of the washing object, wherein the controller is configured to turn on the first fan after the heater is turned on, wherein the controller is configured to, based on the temperature inside the washing space measured at a time point after the first time point, adjust the heating level of the heater or discharge the air inside the washing space at the time point after the first time point, wherein the heating level of the heater at the time point before the first time point is a first heating level, wherein the controller is configured to, based on the temperature inside the washing space measured at a sixth time point after the first time point being less than or equal to a first threshold temperature, adjust the heating level of the heater at the sixth time point to a second heating level that is greater than the first heating level, wherein the sixth time point occurs during the drying process, wherein the controller is configured to, based on the temperature inside the washing space at a seventh time point after the sixth time point reaching a second threshold temperature that is greater than the first threshold temperature, return the heating level of the heater to the first heating level, and wherein the seventh time point occurs during the drying process.

2. The dishwasher of claim 1, wherein, at the first time point, the air inside the washing space is discharged to the outside of the tub through the partially opened door.

3. The dishwasher of claim 2, wherein the controller is configured to control the door actuator to close the partially opened door at a second time point after the first time point and to open the closed door at a third time point after the second time point, and wherein the second time point and the third time point occur during the drying process.

4. The dishwasher of claim 2, further comprising:

an air discharge outlet configured to discharge the heated air into the washing space.

5. The dishwasher of claim 1, wherein the controller is configured to not discharge the air inside the washing space at a time point prior to the first time point, and to discharge the air inside the washing space at the first time point, wherein the controller is configured to, based on the temperature inside the washing space measured at a sixth time point after the first time point being less than or equal to a first threshold temperature, not discharge the air inside the washing space, and wherein the sixth time point occurs during the drying process.

6. The dishwasher of claim 5, wherein the controller is configured to, based on the temperature inside the washing space measured at a seventh time point after the sixth time point reaching a second threshold temperature that is greater than the first threshold temperature, discharge the air inside the washing space, and wherein the seventh time point occurs during the drying process.

* * * * *